US005669941A

United States Patent [19]

Peterson

[11] Patent Number: 5,669,941

[45] Date of Patent: Sep. 23, 1997

[54] COATED ABRASIVE ARTICLE

[75] Inventor: Larry L. Peterson, Hudson, Wis.

[73] Assignee: Minnesota Mining and Manufacturing Company, St. Paul, Minn.

[21] Appl. No.: 582,325

[22] Filed: Jan. 5, 1996

[51] Int. Cl.[6] ..... B24D 3/34

[52] U.S. Cl. ..... 51/295; 51/309

[58] Field of Search ..... 51/293, 295, 309

[56] References Cited

U.S. PATENT DOCUMENTS

| | | | |
|---|---|---|---|
| 1,910,444 | 5/1933 | Nicholson | 51/308 |
| 2,127,504 | 8/1938 | Derr et al. | 23/143 |
| 3,041,156 | 6/1962 | Rowse et al. | 51/298 |
| 3,340,205 | 9/1967 | Hayes et al. | 252/313 |
| 3,562,968 | 2/1971 | Johnson et al. | 51/389 |
| 3,957,598 | 5/1976 | Merkl | 204/72 |
| 4,314,827 | 2/1982 | Leitheiser et al. | 51/298 |
| 4,623,364 | 11/1986 | Cottringer et al. | 51/309 |
| 4,744,802 | 5/1988 | Schwabel | 51/309 |
| 4,770,671 | 9/1988 | Monroe et al. | 51/293 |
| 4,798,814 | 1/1989 | Everitt et al. | 501/89 |
| 4,881,951 | 11/1989 | Wood et al. | 51/309 |
| 4,903,440 | 2/1990 | Larson et al. | 51/298 |
| 4,951,423 | 8/1990 | Johnson | 451/526 |
| 4,964,883 | 10/1990 | Morris et al. | 51/293 |
| 4,997,461 | 3/1991 | Markhoff-Matheny et al. | 51/295 |
| 5,009,675 | 4/1991 | Kunz et al. | 51/925 |
| 5,011,508 | 4/1991 | Wald et al. | 51/293 |
| 5,042,991 | 8/1991 | Kunz et al. | 51/295 |
| 5,085,671 | 2/1992 | Martin et al. | 51/293 |
| 5,090,968 | 2/1992 | Pellow | 51/293 |
| 5,139,978 | 8/1992 | Wood | 501/127 |
| 5,164,348 | 11/1992 | Wood | 501/127 |
| 5,201,916 | 4/1993 | Berg et al. | 51/293 |
| 5,213,591 | 5/1993 | Celikkaya et al. | 51/293 |
| 5,219,806 | 6/1993 | Wood | 501/127 |
| 5,316,812 | 5/1994 | Stout et al. | 428/64 |
| 5,417,726 | 5/1995 | Stout et al. | 51/295 |
| 5,429,647 | 7/1995 | Larmie | 51/295 |
| 5,489,318 | 2/1996 | Erickson et al. | 51/309 |
| 5,498,269 | 3/1996 | Larmie | 51/295 |

FOREIGN PATENT DOCUMENTS

| | | | |
|---|---|---|---|
| 1139258 | 1/1969 | United Kingdom | C08F 47/00 |
| WO 94/07809 | 4/1994 | WIPO | C04B 35/10 |
| WO 94/07969 | 4/1994 | WIPO | C09K 3/14 |
| WO 95/00295 | 1/1995 | WIPO | B24D 13/14 |
| WO 95/13251 | 5/1995 | WIPO | C04B 35/111 |

*Primary Examiner*—Deborah Jones

*Attorney, Agent, or Firm*—Gary L. Griswold; Walter N. Kirn; Gregory D. Allen

[57] ABSTRACT

The present invention provides a coated abrasive article, wherein the backing includes a tough, heat resistant, thermoplastic binder material, and an effective amount of a fibrous reinforcing material distributed throughout the thermoplastic binder material. The abrasive grain adhered to the backing comprise rare earth oxide-modified alpha alumina-based abrasive grain, which exhibit a surprising improvement in grinding performance in conjunction with the backing.

26 Claims, 2 Drawing Sheets

COATED ABRASIVE ARTICLE

FIELD OF THE INVENTION

This invention relates to coated abrasive articles comprising rare earth oxide modified alumina-based ceramic abrasive grain bonded to a thermoplastic backing.

DESCRIPTION OF RELATED ART

Coated abrasive articles are used in a wide variety of applications ranging from heavy duty gate removal to polishing eye glass lenses. Conventional coated abrasive articles generally comprise a backing having a plurality of abrasive grain bonded to the front surface of the backing by means of one or more adhesive binders. In heavy duty applications (i.e., in applications in which the coated abrasive removes or abrades a relatively large amount of the workpiece surface) the backing must have sufficient strength so as not to degrade during use.

Over the last several decades, conventional vulcanized fiber backings have been widely used in coated abrasive discs for grinding welds, gates, burrs, and other heavy duty applications. Although vulcanized fiber backings, which exhibit good strength and heat resistance characteristics, are well suited for use in a coated abrasive article used for heavy duty grinding applications, at elevated humidities (typically above about 50% RH) vulcanized fiber backings tend to deform. For example, at elevated humidities, a coated abrasive disc having a vulcanized fiber backing tends to "cup" or curl. This cupping or curling, which is undesirable, can be so severe that the abrasive article cannot be properly used. An alternative to the vulcanized fiber backing is described in U.S. Pat. No. 5,316,812 (Stout et al.). This alternative backing, which comprises a fibrous reinforced thermoplastic binder material, is less effected by elevated humidities than are vulcanized fiber backings.

Conventional abrasive grain include silicon carbide, boron carbide, diamond, garnet, cubic boron nitride, aluminum oxide, alumina-zirconia, and combinations thereof. Aluminum oxide grain include fused aluminum oxides, heat treated aluminum oxides, and ceramic aluminum oxides. Examples of useful ceramic aluminum oxides include those disclosed in U.S. Pat. Nos. 4,314,827 (Leitheiser et al.), 4,744,802 (Schwabel), 4,770,671 (Monroe et al.), and 5,011,508 (Wald et al.). Some ceramic aluminum oxide abrasive grain compositions are known to be particularly well suited for abrading certain types of metals. For example, alpha alumina- and iron oxide-seeded alpha alumina abrasive grain, such as those described in U.S. Pat. Nos. 4,623,364 (Cottringer) and 4,744,802 (Schwabel), for example, are particularly well suited, and are commonly used, for abrading 1018 mild steel. Rare earth oxide-modified alpha alumina abrasive grain, such as that disclosed in U.S. Pat. No. 4,881,951 (Wood et al.), for example, are particularly well suited, and are commonly used, for abrading 304 stainless steel and exotic metals such as titanium.

SUMMARY OF THE INVENTION

Surprisingly, in accordance with the present invention, it has been found that there is a synergistic grinding effect (particularly in grinding metals, such as 1018 mild steel) when a fibrous reinforced thermoplastic backing material is used with a rare earth oxide-modified alumina-based ceramic abrasive grain. Accordingly, the present invention provides a coated abrasive article comprising:

(a) a reinforced thermoplastic backing having a front and a back surface, wherein the backing comprises:

(i) a tough, heat resistant, thermoplastic binder material; and (ii) a fibrous reinforcing material distributed throughout said tough, heat resistant, thermoplastic binder material;

(b) a binder adhesive; and (c) rare earth oxide-modified alpha alumina-based abrasive grain bonded to the front surface of the backing by the binder adhesive; wherein the rare earth oxide-modified alpha alumina-based abrasive grain comprises:

(i) about 70–99.9% by weight alumina, calculated on a theoretical oxide basis as $Al_2O_3$, based on the total weight of the abrasive grain, wherein at least about 35% by weight of the alumina is present as alpha alumina; and (ii) about 0.1–30% by weight rare earth oxide selected from the group consisting of praseodymium oxide, samarium oxide, ytterbium oxide, neodymium oxide, europium oxide, lanthanum oxide, gadolinium oxide, cerium oxide, dysprosium oxide, erbium oxide and mixtures of two or more thereof, calculated on a theoretical oxide basis as $Pr_2O_3$, $Sm_2O_3$, $Yb_2O_3$, $Nd_2O_3$, $Eu_2O_3$, $La_2O_3$, $Gd_2O_3$, $Ce_2O_3$, $Dy_2O_3$, and $Er_2O_3$, respectively, based on the total weight of the abrasive grain;

wherein the coated abrasive article, when used to abrade 1018 mild steel using a hydraulic slide action test, exhibits a grinding performance at least about 20% greater than a coated abrasive article having an iron oxide-nucleated alpha alumina-based ceramic abrasive grain, the binder adhesive, and a vulcanized fiber backing.

In another aspect, the present invention provides a coated abrasive article comprising:

(a) a reinforced thermoplastic backing having a front and a back surface, wherein said backing comprises:

(i) 60–99 wt-% of a tough, heat resistant, thermoplastic binder material;

(ii) a fibrous reinforcing material distributed throughout said tough, heat resistant, thermoplastic binder material; and (iii) a toughening agent;

(b) a binder adhesive comprising a resole phenolic resin and particulate material; and (c) rare earth oxide-modified alpha alumina-based abrasive grain bonded to the front surface of the backing by said binder adhesive; wherein the rare earth oxide-modified alpha alumina-based abrasive grain comprise:

(i) about 70–99.9% by weight alumina, calculated on a theoretical oxide basis as $Al_2O_3$, based on the total weight of the abrasive grain, wherein at least about 35% by weight of the alumina is present as alpha alumina;

(ii) about 0.1–30% by weight rare earth oxide selected from the group consisting of praseodymium oxide, samarium oxide, ytterbium oxide, neodymium oxide, europium oxide, lanthanum oxide, gadolinium oxide, cerium oxide, dysprosium oxide, erbium oxide and mixtures of two or more thereof, calculated on a theoretical oxide basis as $Pr_2O_3$, $Sm_2O_3$, $Yb_2O_3$, $Nd_2O_3$, $Eu_2O_3$, $La_2O_3$, $Gd_2O_3$, $Ce_2O_3$, $Dy_2O_3$, and $Er_2O_3$, respectively, based on the total weight of the abrasive grain;

wherein the coated abrasive article, when used to abrade 1018 mild steel using a hydraulic slide action test, exhibits a grinding performance at least about 50% greater than a coated abrasive article having an iron oxide-nucleated alpha alumina-based ceramic abrasive grain, the binder adhesive, and a vulcanized fiber backing.

In another embodiment, the present invention provides a coated abrasive article comprising:

(a) a reinforced thermoplastic backing having a front and a back surface, wherein said backing comprises:

(i) a tough, heat resistant, thermoplastic binder material;

(ii) a fibrous reinforcing material distributed throughout said tough, heat resistant, thermoplastic binder material; and (iii) a toughening agent;

(b) a binder adhesive comprising a resole phenolic resin and particulate material; and (c) rare earth oxide-modified alpha alumina-based abrasive grain bonded to the front surface of the backing by said binder adhesive; wherein said rare earth oxide-modified alpha alumina-based abrasive grain comprising, on a theoretical oxide basis, about 1.2% $Y_2O_3$, about 1.2% $Nd_2O_3$, about 1.2% $La_2O_3$, about 1.2% MgO, and about 95.2% $Al_2O_3$, based on the total weight of the abrasive grain.

A preferred backing for the coated abrasive article according to the present invention is described in U.S. Pat. No. 5,316,812 (Stout et al.), the disclosure of which is incorporated herein by reference. Such backings comprise a fibrous material distributed throughout a thermoplastic binder, and can be utilized in relatively severe grinding conditions, without significant deformation or deterioration of the backing. The phrase "severe grinding conditions" as used herein means that the temperature and pressure at the abrading interface (during grinding) is at least about 200° C. (usually at least about 300° C.), and at least about 1 kg/cm$^2$ (usually at least about 3 kg/cm$^2$), respectively. The temperature and pressure at the abrading interface of the surface being abraded are the instantaneous or localized values experienced by the coated abrasive article at the point of contact between the abrasive grain on the backing and the workpiece, without an external cooling source such as a water spray. Although the instantaneous or localized temperatures can be higher than 200° C. during grinding, and are often higher than 300° C., the backing typically experiences an overall or equilibrium temperature of less than these values due to thermal dissipation.

In this application:

"alumina-based abrasive grain precursor" or "abrasive grain precursor" refer to either dried alumina-based dispersion or solution or calcined alumina-based dispersion or solution in the form of particles, which may be partially sintered, that have a density of less than about 85% (typically less than about 60%) of theoretical, and are capable of being sintered, or impregnated with an impregnating composition and then sintered to provide sintered alpha alumina-based ceramic abrasive grain;

"alumina source" refers to the starting alumina type material present in the original dispersion or solution, such as alpha alumina or alpha alumina precursor (e.g., boehmite, transitional alumina, or an aluminum salt such as aluminum formate and aluminum acetate);

"abrasive grain" or "sintered abrasive grain" refer to ceramic abrasive grain precursor that has been sintered to a density at least about 85% (preferably, at least about 90%, and more preferably, at least about 95%) of theoretical, and contain, on a theoretical (elemental) oxide basis, at least about 60% by weight $Al_2O_3$, wherein at least about 50% by weight of the total amount of $Al_2O_3$ is present as alpha alumina;

"impregnating composition" refers to a solution or dispersion of a liquid medium and a metal oxide and/or precursor that can be impregnated into abrasive grain precursor to form impregnated abrasive grain precursor (either impregnated dried particles or impregnated calcined particles);

"iron oxide-nucleated alpha alumina-based ceramic abrasive grain" refers to abrasive grain containing, on a theoretical (elemental) oxide basis, about 1.2% $Fe_2O_3$, about 4.5% MgO, and about 94.3% $Al_2O_3$, based on the total weight of the abrasive grain, having a density of greater than 95% of theoretical and submicron alpha alumina crystallites, prepared as described in the Examples;

"nucleating agent" refers to material that enhances the transformation of transitional alumina(s) to alpha alumina;

"nucleating material" refers to a nucleating agent or a precursor thereof;

"ceramic" means that the abrasive grain is made by a sintering process (as opposed to a fusion process, where the abrasive grain is heated above its melting temperature), the sintering temperature being below the melting point temperature of the abrasive grain; and "transitional alumina" refers to any crystallographic form of alumina which exists after heating alumina to remove any water of hydration prior to transformation to alpha alumina (e.g., eta, theta, delta, chi, iota, kappa, and gamma forms of alumina and any intermediate combinations of such forms).

DETAILED DESCRIPTION OF PREFERRED EMBODIMENTS

Figure 1:
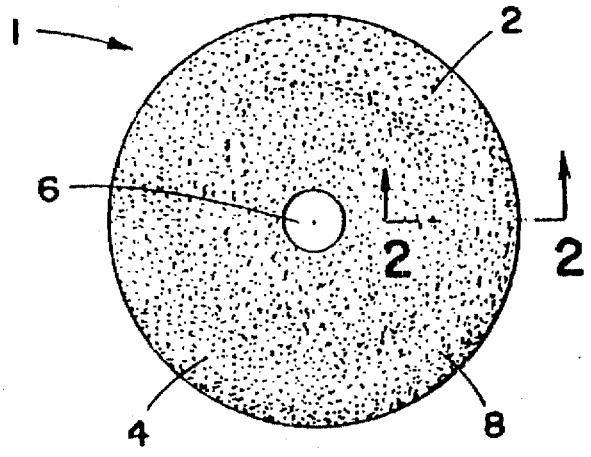
FIG. 1 is a front view of a coated abrasive article according to the present invention.

Referring to FIG. 1, coated abrasive disc 1 has working surface 2 of a coated abrasive disc according to the present invention. Herein, working surface 2 is also referred to as a front surface or a top surface, and generally represents the surface used for abrading workpieces. The representation shows two general regions 4 and 6. Region 4 includes abrasive layer 2. Region 6 is a center hole in circular disc 1 for use in mounting on a rotatable shaft of a grinding apparatus.

Generally, the diameter of the disc is within the size range of about 6–60 cm. Preferably, the disc diameter is about 11–30 cm (more preferably about 17–23 cm). Typically, the disc has a center hole (i.e., region 6 in FIG. 1), which is usually about 2–3 cm in diameter.

Figure 2:
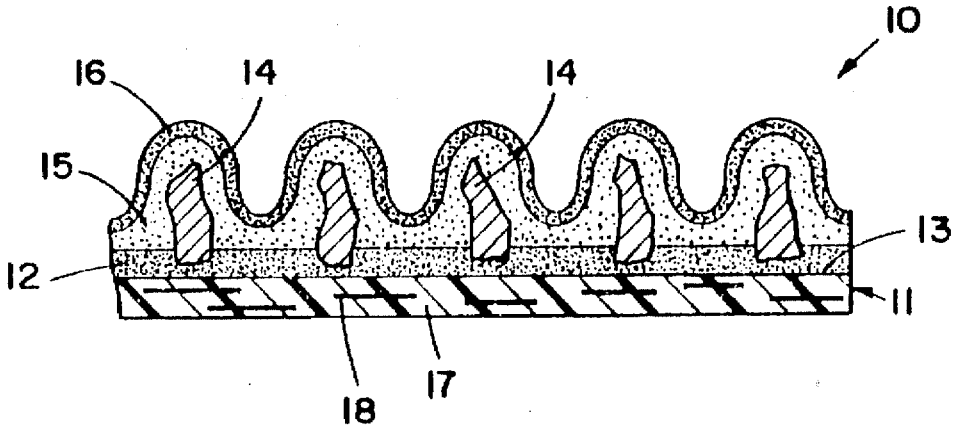
FIG. 2 is an enlarged fragmentary side, cross-sectional view of a coated abrasive article according to the present invention, taken along line 2—2 of FIG. 1.

Referring to FIG. 2, in general, coated abrasive article 10 includes backing 11, and first binder adhesive layer 12 (commonly referred to as a "make coat") applied to working surface 13 of backing 11. The purpose of binder adhesive layer 12 is to secure abrasive grain 14 to front surface 13 of backing 11. Second binder adhesive layer 15 (commonly referred to as a "size coat") is coated over abrasive grain 14 and binder adhesive layer 12. The purpose of the size coat is to securely anchor abrasive grain 14 to backing 11. Third binder adhesive layer 16 (commonly referred to as a "supersize coat") may be coated over second binder adhesive layer 15. Binder adhesive layer 16 is optional, and is typically utilized in coated abrasives that abrade very hard workpieces (e.g., stainless steel or exotic metal workpieces).

The thickness of backing 11 is typically less than about 1.5 mm for flexibility and material conservation. Preferably, the thickness of backing 11 is in the range from about 0.5–1.2 mm for optimum flexibility. More preferably, the thickness of backing 11 is in the range from about 0.7–1.0 mm.

Backing 11 is made of thermoplastic binder material 17 and fibrous reinforcing material 18. Fibrous reinforcing material 18 can be in the form of individual fibers or strands, or in the form of a fiber mat or web. Whether fibrous reinforcing material 18 is in the form of individual fibers or a mat, it is preferably distributed throughout thermoplastic binder material 17 in the body of the backing. More preferably, this distribution is substantially uniform throughout the body of backing 11. That is, the fibrous reinforcing material is not merely applied to a surface of the body of the backing, or within separate layers of the backing, but rather, it is substantially completely within the internal structure of, and distributed throughout, the backing. Of course, a fibrous mat or web structure could be of sufficient dimensions to be distributed throughout the backing binder.

Although FIGS. 1 and 2 illustrate representative coated abrasive articles according to the present invention, other constructions having other shapes and forms are also within the scope of the present invention. The backing of the coated abrasive article can have a variety of shapes depending upon the intended use. For example, the backing can be tapered so that the center portion of the backing is thicker than the outer portions. The backing can have a uniform thickness or can be embossed with a raised pattern such as dots in concentric circles or in radial arms.

The center of the backing can be depressed, or lower, than the outer portions. The backing shape can also be square, rectangular, octagonal, circular, in the form of a belt, or in any other geometric form. The edges of the backing can be purposely bent to make a "cupped" disc if so desired. The edges of the backing can also be smooth or scalloped.

The backing may preferably have a series of ribs (i.e., alternating thick and thin portions) molded into the backing for further advantage when desired for certain applications. The molded-in ribs can be used for designing in a required stiffness or "feel during use" (using finite element analysis), improved cooling, improved structural integrity, and increased torque transmission when the ribs interlock with a back-up pad. These ribs can be straight or curved, radial, concentric circles, random patterns, or combinations thereof.

Figure 3:
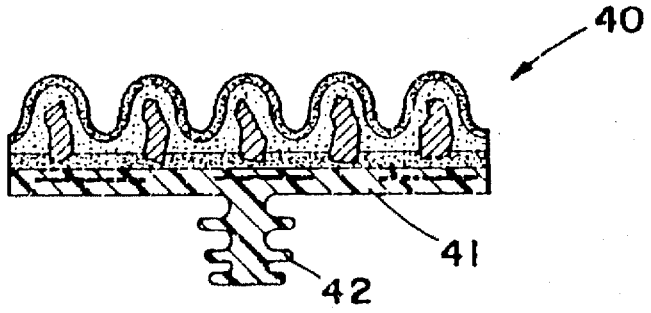
FIG. 3 is an enlarged fragmentary side cross-sectional view of a coated abrasive article according to the present invention in the form of a disc, with an attachment system.

Additionally, the backing can be made to include an attachment system such as illustrated in FIG. 3. Referring to FIG. 3, coated abrasive 40 has backing 41 and attachment system 42. Attachment system 42 and backing 41 are unitary and integral (i.e., one continuous (molded) structure). This type of attachment system is further illustrated, for example, in U.S. Pat. No. 3,562,968 (Johnson et al.), the disclosure of which is incorporated herein by reference. Typically, if the attachment system is a molded-in attachment system (i.e., molded directly into the backing), then the diameter of the backing is less than about 12 cm (preferably, less than about 8 cm). Further, the attachment also preferably is made of a hardened composition of thermoplastic binder material and fibrous reinforcing material distributed throughout the thermoplastic binder material. Such an integral attachment system is advantageous, for example, because of the ease and certainty of mounting a backing in the center of a hub. That is, if the backing is in the shape of a disc, the attachment system can be located in the geometric center of the disc thereby allowing for centering easily on the hub.

Figure 4:
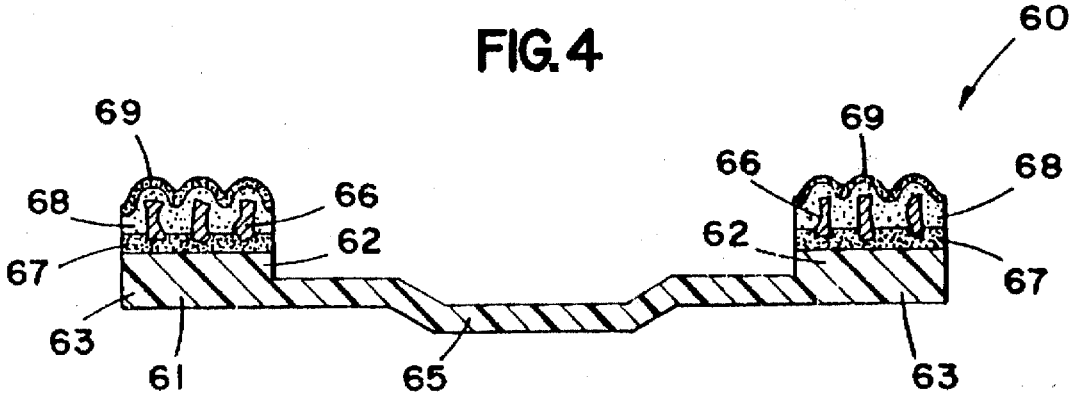
FIG. 4 is an enlarged fragmentary side, cross-sectional view of another coated abrasive article according to the present invention in the form a disc, taken generally analogously to FIG. 2 but extending across the entire diameter of the disc, and slightly offset from the middle such that the center hole (analogous to region 6, FIG. 1) is not shown.

Referring to FIG. 4, coated abrasive article 60 has three-dimensional molded backing disc 61 with raised edge region 62. Raised edge region 62 is a region of greater thickness in backing 61 at outer edge region 63, relative to center region 65. Preferably, raised edge region 62 generally represents an increased thickness in the backing of about 2.3 to 10.3 mm relative to the thickness in center region 65. Raised edge region 62 can be of any desired width. Preferably, raised edge region 62 represents a 3.5–5.5 cm ring at outer edge region 63 of backing 61. Typically, and preferably, raised edge region 62 is the only region of backing 61 that is coated with abrasive grain 66 and make, size, and supersize binder adhesive layers 67, 68, and 69, respectively. This embodiment thus has a raised ring-shaped region around the outer portion of a disc that is coated with abrasive grain. Because there is generally no need to have abrasive grain coated on the surface of center region 65 of the disc, discs with this shape are typically more economical. Although this embodiment is in the shape of a disc, a raised edge region of binder adhesive and abrasive grain can be incorporated into a coated abrasive article of any desired shape.

Figure 5:
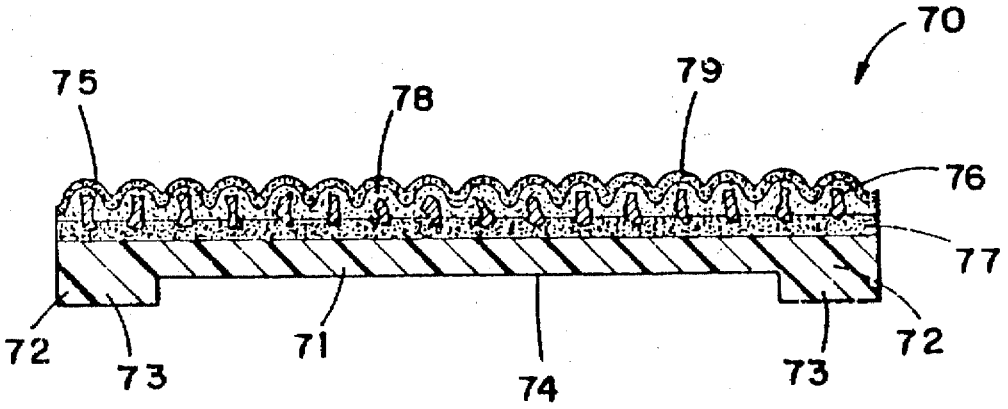
FIG. 5 is an enlarged fragmentary side cross-sectional view of another coated abrasive article according to the present invention in the form a disc, taken generally analogously to FIG. 2, but extending across the entire diameter of the disc, and slightly offset from the middle such that the center hole (analogous to region 6, FIG. 1) is not shown.

Alternatively, backings used for the coated abrasive article according to the present invention can have edges of increased thickness for added stiffness. As shown in FIG. 4, this can result in an article with raised edges on which abrasive grain is coated. Alternatively, referring to FIG. 5, coated abrasive disc 70 has backing 71 having molded-in edge region 72 of increased thickness at outer edge region 73. Edge region 72 represents a very small surface area relative to the overall surface area of disc 70, and protrudes away from abrasive surface 75 (i.e., the surface that contacts the workpiece). Edge region 72, which is in the form of a ring of greater thickness at outer edge region 73, relative to center region 74, imparts increased stiffness such that the disc can withstand greater stress before flexing.

Backing

Preferably, the fibrous reinforcing material is distributed throughout the thermoplastic binder material. The fibrous reinforcing material generally consists of fibers (i.e., fine thread-like pieces) with an aspect ratio of at least about 10:1 (typically greater than 100:1). The binder material and the fibrous reinforcing material together form a hardened composition that does not substantially deform or disintegrate during use. Preferably, the "tough, heat resistant" thermoplastic binder material imparts desirable characteristics to the hardened composition such that it does not substantially deform or disintegrate under a variety of abrading (i.e., grinding) conditions. More preferably, the hardened composition of fibrous reinforcing material and tough, heat resistant, thermoplastic binder material does not substantially deform or disintegrate under any grinding conditions, particularly under severe grinding conditions.

The backing preferably comprises thermoplastic binder material in the range from about 60–99% by weight, and fibrous reinforcing material in the range from about 1 to about 40 percent by weight, based upon the weight of the backing. The amount of fibrous reinforcing material is preferably in an amount effective to provide a backing that will withstand severe grinding conditions. Preferably, the melting point of the thermoplastic binder material is at least about 200° C. The thermoplastic material can be selected, for example, from the group consisting of polycarbonates, polyetherimides, polyesters, polysulfones, polystyrenes, acrylonitrile-butadiene-styrene block copolymers, acetal polymers, polyamides, and combinations thereof. The most preferred thermoplastic binder material is a polyamide material.

The fibrous reinforcing material is preferably in the form of individual fibers or fibrous strands, such as glass fibers. The melting point of the fibrous reinforcing material is preferably at least about 25° C. above the melting point of the thermoplastic binder material.

Preferably, the backing includes a toughening agent in the range from about 1 to about 30 percent by weight, based on the weight of the backing, therein. The toughening agent is preferably a rubber toughener or a plasticizer. More preferably, the toughening agent is selected from the group consisting of toluenesulfonamide derivatives, styrene butadiene copolymers, polyether backbone polyamides, rubber-polyamide graft copolymers, triblock polymers of styrene-(ethylene butylene)-styrene, and mixtures thereof. Of these toughening agents, rubber-polyamide copolymers and styrene-(ethylene butylene)-styrene triblock polymers are more preferred, with rubber-polyamide copolymers the most preferred.

Preferably, the backing is sufficiently tough and heat resistant under severe grinding conditions such that the backing does not significantly disintegrate or deform from the heat generated during a grinding, sanding, or polishing operation. For example, preferably the backing can operably withstand a temperature at the abrading interface of a workpiece of at least about 200° C. (preferably at least about 300° C.). The phrase "at the abrading interface" in the context of temperature and pressure refers to the instantaneous or localized temperature and pressure the backing experiences at the contact point between the abrasive material on the article and the workpiece. Thus, the equilibrium or overall temperature of the backing would typically be less than the instantaneous or localized temperature at a contact point between the coated abrasive on the article and the workpiece during operation. Backings that withstand these conditions also typically withstand the temperatures used in the curing of the adhesive layers of a coated abrasive article without disintegration or deformation.

In another aspect, the backing preferably is sufficiently tough such that it will not significantly crack or shatter from the forces encountered during grinding, preferably under severe grinding conditions. That is, the backing can preferably operably withstand use in a grinding operation conducted with a pressure at the abrading interface of a workpiece of at least about 1 kg/cm$^2$ (preferably at least about 3 kg/cm$^2$).

In yet another aspect, the backing preferably exhibits sufficient flexibility to withstand typical grinding conditions and preferably severe grinding conditions. By "sufficient flexibility" it is meant that the backing can bend and return to its original shape without significant permanent deformation. That is, for preferred grinding operations, a "flexible" backing is capable of flexing and adapting to the contour of the workpiece being abraded without permanent deformation of the backing, and yet is sufficiently strong to transmit an effective grinding force when pressed against the workpiece.

Preferably, the backing possesses a flexural modulus of at least about 17,500 kg/cm$^2$ under ambient conditions, with a sample size of 25.4 mm (width)×50.8 mm (span across the jig)×0.8–1.0 mm (thickness), and a rate of displacement of 4.8 mm/min., as determined by following the procedure outlined in American Society for Testing and Materials (ASTM) D790 (1992) test method, which is incorporated herein by reference. Briefly, ASTM D790 test method involves the use of either a threepoint loading system utilizing center loading by means of a loading nose, which has a cylindrical surface, midway between two supports, each of which have a cylindrical surface; or a four-point loading system utilizing two load points equally spaced from their adjacent support points, with a distance between load points of either one-third or one-half of the support span. The specimen is deflected until rupture occurs or until the maximum strain has reached 0.05 mm/mm (i.e., a 5% deflection). The flexural modulus (i.e., tangent modulus of elasticity) is determined by the initial slope of the load vs. deflection curve.

More preferably, the backing possesses a flexural modulus in the range from about 17,500 kg/cm$^2$ to about 141,000 kg/cm$^2$. A backing with a flexural modulus less than about 17,500 kg/cm$^2$ generally does not possess sufficiently stiffness to controllably abrade the surface of the workpiece. A backing with a flexural modulus greater than about 141,000 kg/cm$^2$ generally is too stiff to adequately conform to the surface of the workpiece.

A preferred backing has a Gardner Impact value, as measured by the test procedures outlined in ASTM D256 (1992) test methods, which are incorporated herein by reference, of at least about 0.4 Joule for a 0.89 mm thick sample under ambient. These test procedures involve a determination of the force required to break a standard test specimen of a specified size. More preferably, the backing has a Gardner Impact value of at least about 0.9 Joule (most preferably, at least about 1.6 Joules) for a 0.89 mm thick sample under ambient conditions.

A preferred backing has a tensile strength (i.e., the greatest longitudinal stress a substance can withstand without tearing apart), as measured by the procedure outlined in ASTM D5026 (1989), which is incorporated herein by reference, of at least about 17.9 kg/cm of width at about 150° C. for a sample thickness of about 0.75–1.0 mm. This tensile measurement is taken of the backing alone, i.e., without the abrasive grain and binder adhesive(s).

A preferred backing also exhibits appropriate shape control and is relatively insensitive to environmental conditions such as humidity and temperature. By this it is meant that preferred backings possess the above-listed properties (e.g., toughness, heat resistance, flexibility, stiffness, adhesion) under a wide range of environmental conditions. Preferably, the backing possesses the above-listed properties within a temperature range of about 10°–30° C., and a humidity range of about 30–50% relative humidity (RH), although it is desired that the backing possesses the above-listed properties at temperatures below 0° C. to temperatures above 100° C., and within a wide range of relative humidity values, anywhere from below 10% RH to above 90% RH.

A preferred backing for use in making a coated abrasive article according to the present invention is compatible with, and has good adhesion to, the binder adhesive layers, particularly the make coat. Good adhesion is determined by the amount of "shelling" of the abrasive grain. Shelling is a term used in the abrasive industry to describe the undesired, premature release of the abrasive grain from the backing. Although the choice of backing material is important, the amount of shelling typically depends to a greater extent on the choice of adhesive binder and the compatibility of the backing and adhesive binder.

The coated abrasive articles of the present invention include a backing, which contains a thermoplastic binder material and a fibrous reinforcing material. Preferably, the amount of the thermoplastic binder material in the backing is within a range of about 60–99%, more preferably within a range of about 65–95%, and most preferably within a range of about 70–85%, based upon the weight of the backing. The remainder of the typical, preferred backing is primarily a fibrous reinforcing material with few, if any, voids throughout the hardened backing composition. However, there can be additional components added to the binder composition.

Typically, the higher the content of the reinforcing material, the stronger the backing will be; however, if there is not a sufficient amount of thermoplastic binder, then the adhesion to the make coat (i.e., the first adhesive layer), may be deficient. Furthermore, if there is too much fibrous reinforcing material, the backing can be too brittle for desired applications. By proper choice of thermoplastic binder material and fibrous reinforcing material, such as, a polyamide thermoplastic binder and glass reinforcing fiber, considerably higher levels of the binder can be employed to produce a backing composition with few if any voids and with the properties as described above.

Backing Binder

The preferred binder in the backing of the coated abrasive articles of the present invention is a thermoplastic material. A thermoplastic binder material is defined as a polymeric material that softens and melts when exposed to elevated temperatures and generally returns to its original condition (i.e., its original physical state) when cooled to ambient temperatures. During the manufacturing process, the thermoplastic binder material is heated above its softening temperature, and preferably above its melting temperature, to cause it to flow and form the desired shape of the coated abrasive backing. After the backing is formed, the thermoplastic binder is cooled and solidified. In this way the thermoplastic binder material can be molded into various shapes and sizes.

Preferred moldable thermoplastic binder materials are those having a high melting temperature, good heat resistant properties, and good toughness properties such that the hardened backing composition containing these materials operably withstands abrading conditions without substantially deforming or disintegrating. The toughness of the thermoplastic material can be measured by impact strength. Preferred thermoplastic material for use in the backings of the present invention has a Gardner Impact value of at least about 0.4 Joule for a 0.89 mm thick sample under ambient conditions. More preferably, the "tough" thermoplastic material used in the backings of the present invention have a Gardner Impact value of at least about 0.9 Joule, and more preferably at least about 1.6 Joules, for a 0.89 mm thick sample under ambient conditions.

In order to provide the backing with the necessary thermal resistance, preferred thermoplastic binders have a melting point of at least about 200° C., and more preferably at least about 220° C. Additionally, the melting temperature of the tough, heat resistant, thermoplastic material is preferably sufficiently lower (i.e., at least about 25° C. lower) than the melting temperature of the fibrous reinforcing material. In this way, the reinforcing material is not adversely affected during the molding of the thermoplastic binder. Furthermore, the thermoplastic material in the backing is sufficiently compatible with the material used in the adhesive layers such that the backing does not deteriorate, and such that there is effective adherence of the abrasive grain to the backing. Preferred thermoplastic materials are also generally insoluble in an aqueous environment, at least because of the desire to use the coated abrasive articles according to the present invention on wet surfaces.

Examples of thermoplastic materials suitable for preparations of backings in coated abrasive articles according to the present invention include polycarbonates, polyetherimides, polyesters, polysulfones, polystyrenes, acrylonitrile-butadiene-styrene block copolymers, acetal polymers, polyamides, or combinations thereof. Of this list, polyamides and polyesters are preferred. Polyamide materials are the most preferred thermoplastic binder materials, at least because they are inherently tough and heat resistant, typically provide good adhesion to the preferred binder resins without priming, and are relatively inexpensive.

If the thermoplastic binder material from which the backing is formed is a polycarbonate, polyetherimide, polyester, polysulfone, or polystyrene material, use of a primer may be preferred to enhance the adhesion between the backing and the make coat. The term "primer" as used in this context is meant to include both mechanical and chemical type primers or priming processes. Examples of mechanical priming processes include, but are not limited to, corona treatment and scuffing, both of which increase the surface area of the backing.

The most preferred thermoplastic material from which the backing of the present invention is formed is a polyamide resin material, which is characterized by having an amide group, i.e., —C(O)NH—. Various types of polyamide resin materials (i.e., nylons such as nylon 6/6 or nylon 6) can be used. If a phenolic-based make coat (i.e., first adhesive layer) is used, the preferred nylon is nylon-6. This is because excellent adhesion can be obtained between nylon 6 and phenolic-based adhesives. Nylon 6/6 is a condensation product of adipic acid and hexamethylenediamine and has a melting point of about 264° C. and a tensile strength of about 770 kg/cm$^2$. Nylon 6 is a polymer of ε-caprolactam and has a melting point of about 223° C. and a tensile strength of about 700 kg/cm$^2$. Examples of commercially available nylon resins useable as backings in articles according to the present invention include those known under the trade designations "VYDYNE" from Monsanto, St. Louis, Mo., "ZYTEL" and "MINLON" both from DuPont, Wilmington, Del.; "TROGAMID T" from Huls America, Inc., Piscataway, N.J., "CAPRON" from Allied Chemical Corp., Morristown, N.J.; "NYDUR" from Mobay, Inc., Pittsburgh, Pa.; "DURATHAN" from Bayer Corp., Pittsburgh, Pa.; and "ULTRAMID" from BASF Corp., Parsippany, N.J. Although a mineral filled thermoplastic material can be used, such as the mineral-filled nylon 6 resin "MINLON," the mineral therein is not characterized as a "fiber" or "fibrous material," as defined herein; rather, the mineral is in the form of particles, which possess an aspect ratio typically below 100:1.

Besides the thermoplastic binder material, the backings useful for the abrasive article according to the present invention include an effective amount of a fibrous reinforcing material. Herein, an "effective amount" of a fibrous reinforcing material is a sufficient amount to impart at least improvement in at least one of the physical characteristics of the hardened backing (i.e., at least one or heat resistance, toughness, flexibility, stiffness, shape control, or adhesion), but not so much fibrous reinforcing material as to give rise to any significant number of voids and detrimentally affect the structural integrity of the backing. Preferably, the amount of the fibrous reinforcing material in the backing is within a range of about 1–40%, more preferably within a range of about 5–35%, and most preferably within a range of about 15–30%, based upon the weight of the backing.

The fibrous reinforcing material can be in the form of individual fibers or fibrous strands, or in the form of a fiber mat or web. Preferably, the reinforcing material is in the form of individual fibers or fibrous strands for advantageous manufacture. Fibers are typically defined as fine thread-like pieces with an aspect ratio of at least about 100:1. The aspect ratio of a fiber is the ratio of the longer dimension of the fiber to the shorter dimension. The mat or web can be either in a woven or nonwoven matrix form. A nonwoven mat is a matrix of a random distribution of fibers made by bonding or entangling fibers by mechanical, thermal, or chemical means.

Examples of useful reinforcing fibers include metallic fibers or nonmetallic fibers. The nonmetallic fibers include glass fibers, carbon fibers, mineral fibers, synthetic or natural fibers formed of heat resistant organic materials, or fibers made from ceramic materials. Preferred fibers include nonmetallic fibers, and more preferred fibers include heat resistant organic fibers, glass fibers, or ceramic fibers.

By "heat resistant" organic fibers, it is meant that useable organic fibers must be resistant to melting, or otherwise breaking down, under the conditions of manufacture and use of the coated abrasive article. Examples of useful natural organic fibers include wool, silk, cotton, or cellulose. Examples of useful synthetic organic fibers include polyvinyl alcohol fibers, polyester fibers, rayon fibers, polyamide fibers, acrylic fibers, aramid fibers, or phenolic fibers. The preferred organic fiber is aramid fiber. Such fiber is commercially available from the DuPont Co., Wilmington, Del. under the trade names of "KEVLAR" and "NOMEX."

Generally, any ceramic fiber is useful. An example of a ceramic fiber suitable for the present invention is "NEXTEL" which is commercially available from the 3M Company, St. Paul, Minn.

The most preferred reinforcing fibers for applications of the present invention are glass fibers, at least because they impart desirable characteristics to the coated abrasive articles and are relatively inexpensive. Furthermore, suitable interfacial binding agents exist to enhance adhesion of glass fibers to thermoplastic materials. Glass fibers are typically classified using a letter grade. For example, E glass (for electrical) and S glass (for strength). Letter codes also designate diameter ranges, for example, size "D" represents a filament of diameter of about 6 micrometers and size "G" represents a filament of diameter of about 10 micrometers. Useful grades of glass fibers include both E glass and S glass of filament designations D through U. Preferred grades of glass fibers include E glass of filament designation "G" and S glass of filament designation "G." Commercially available glass fibers are available from Specialty Glass Inc., Oldsmar, Fla.; Owens-Corning Fiberglass Corp., Toledo, Ohio; and Mo-Sci Corporation, Rolla, Mo.

If glass fibers are used, it is preferred that the glass fibers are accompanied by an interfacial binding agent (i.e., a coupling agent) such as a silane coupling agent, to improve the adhesion to the thermoplastic material. Examples of silane coupling agents include those known under the trade designations "Z-6020" and "Z-6040," available from Dow Corning Corp., Midland, Mich.

Advantages can be obtained through use of fiber materials of a length as short as 100 micrometers, or as long as needed for one continuous fiber. Preferably, the length of the fiber will range from about 0.5 mm to about 50 mm, more preferably from about 1 mm to about 25 mm, and most preferably from about 1.5 mm to about 10 mm. The reinforcing fiber denier (i.e., degree of fineness) for preferred fibers ranges from about 1 to about 5000 denier (typically from about 1 to about 1000 denier). More preferably, the fiber denier will range from about 5 to about 300, and most preferably from about 5 to about 200. It is understood that the denier is strongly influenced by the particular type of reinforcing fiber employed.

The reinforcing fiber is preferably distributed throughout the thermoplastic material (i.e., throughout the body of the backing) rather than merely embedded in the surface of the thermoplastic material. This is for the purpose of imparting improved strength and wear characteristics throughout the body of the backing. A construction wherein the fibrous reinforcing material is distributed throughout the thermoplastic binder material of the backing body can be made using either individual fibers or strands, or a fibrous mat or web structure of dimensions substantially equivalent to the dimensions of the finished backing. Although in this preferred embodiment distinct regions of the backing may not have fibrous reinforcing material therein, it is preferred that the fibrous reinforcing material be distributed substantially uniformly throughout the backing.

The fibrous reinforcing material can be oriented as desired for advantageous applications of the present invention. That is, the fibers can be randomly distributed, or they can be oriented to extend along a direction desired for imparting improved strength and wear characteristics. Typically, if orientation is desired, the fibers should generally extend transverse (20 degrees) to the direction across which a tear is to be avoided.

Backings useful for the coated abrasive article according to the present invention can further include an effective amount of a toughening agent. This will be preferred for certain applications. A primary purpose of the toughening agent is to increase the impact strength of the coated abrasive backing. By "an effective amount of a toughening agent" it is meant that the toughening agent is present in an amount to impart at least improvement in the backing toughness without it becoming too flexible. The backings preferably include sufficient toughening agent to achieve the desirable impact test values listed above.

Typically, a preferred backing contains between about 1% and about 30% of the toughening agent, based upon the total weight of the backing. More preferably, the toughening agent (or toughener) is present in an amount of about 5–15 wt-%. The amount of toughener present in a backing may vary depending upon the particular toughener employed. For example, the less elastomeric characteristics a toughening agent possesses, the larger quantity of the toughening agent may be required to impart desirable properties to the backings.

Preferred toughening agents that impart desirable stiffness characteristics to the backing include rubber-type polymers and plasticizers. Of these, the more preferred are rubber toughening agents, most preferably synthetic elastomers.

Examples of preferred toughening agents (i.e., rubber tougheners and plasticizers) include: toluenesulfonamide derivatives (such as a mixture of N-butyl- and N-ethyl-toluenesulfonamide, commercially available from Akzo Chemicals, Chicago, Ill., under the trade designation "KETJENFLEX 8"); styrene butadiene copolymers; polyether backbone polyamides (commercially available from Atochem, Glen Rock, N.J., under the trade designation "PEBAX"); rubber-polyamide copolymers (commercially available from DuPont, Wilmington, Del., under the trade designation "ZYTEL FN"); and functionalized triblock polymers of styrene-(ethylene butylene)-styrene (commercially available from Shell Chemical Co., Houston, Tex., under the trade designation "KRATON FGI 901"); and mixtures of these materials. Of this group, rubber-polyamide copolymers and styrene(ethylene butylene)-styrene triblock polymers are more preferred, at least because of the beneficial characteristics they impart to backings and the manufacturing process of the present invention. Rubber-polyamide copolymers are the most preferred, at least because of the beneficial impact and grinding characteristics they impart to the backings.

If the backing is made by injection molding, typically the toughener is added as a dry blend of toughener pellets with the other components. The process usually involves tumble-blending pellets of toughener with pellets of fiber-containing thermoplastic material. A more preferred method involves compounding the thermoplastic material, reinforcing fibers, and toughener together in a suitable extruder, pelletizing this blend, then feeding these prepared pellets into the injection molding machine. Commercial compositions of toughener and thermoplastic material are available, for example, under the designations "ULTRAMID" from BASF Corp., Parsippany, N.J., and "DURATHAN" from Bayer Corp., Pittsburgh, Pa., including "ULTRAMID B3ZG6" and "DURATHAN BKV-130" are each nylon resins containing a toughening agent and glass fibers.

Besides the materials described above, backings useful in the coated abrasive article according to the invention can include effective amounts of other materials or components depending upon the end properties desired. For example, the backing can include a shape stabilizer (i.e., a thermoplastic polymer with a melting point higher than that described above for the thermoplastic binder material). Suitable shape stabilizers include, but are not limited to, poly(phenylene sulfide), polyimides, and polyaramids. An example of a preferred shape stabilizer is polyphenylene oxide nylon blend commercially available from General Electric, Pittsfield, Mass., under the trade designation "NORYL GTX 910." If a phenolic-based make coat and size coat are employed in the coated abrasive construction, however, the polyphenylene oxide nylon blend is not preferred because of nonuniform interaction between the phenolic resin adhesive layers and the nylon, resulting in reversal of the shape-stabilizing effect. This nonuniform interaction results from a difficulty in obtaining uniform blends of the polyphenylene oxide and the nylon.

Other such materials that may be added to the backing include inorganic or organic fillers. Inorganic fillers are also known as mineral fillers. A filler is a particulate material that typically have a particle size less than about 100 micrometers, preferably less than about 50 micrometers. Examples of useful fillers include carbon black, calcium carbonate, silica, calcium metasilicate, cryolite, phenolic fillers, or polyvinyl alcohol fillers. Although not wishing to be bound by theory if a filler is used, it is believed that the filler fills in between the reinforcing fibers and may prevent crack propagation through the backing. Typically, a filler would not be used in an amount greater than about 20%, based on the weight of the backing. Preferably, at least an effective amount of filler is used. Herein, the term "effective amount" in this context refers to an amount sufficient to fill but not significantly reduce the tensile strength of the hardened backing.

Other useful materials or components that may be added to the backing include, but are not limited to, pigments, oils, antistatic agents, flame retardants, heat stabilizers, ultraviolet stabilizers, internal lubricants, antioxidants, and processing aids. One would not typically use more of these components than needed for desired results.

Abrasive Grain

The abrasive grain used in the articles of the present invention are rare earth oxide-modified alpha alumina-based abrasive grain comprising about 70–99.9% by weight alumina, calculated on a theoretical (elemental) oxide basis as $Al_2O_3$, based on the total weight of the abrasive grain, wherein at least about 35% by weight of the alumina is present as alpha alumina; and about 0.1–30% by weight rare earth oxide selected from the group consisting of praseodymium oxide, samarium oxide, ytterbium oxide, neodymium oxide, europium oxide, lanthanum oxide, gadolinium oxide, cerium oxide, dysprosium oxide, erbium oxide and mixtures of two or more thereof, calculated on a theoretical (elemental) oxide basis as $Pr_2O_3$, $Sm_2O_3$, $Yb_2O_3$, $Nd_2O_3$, $Eu_2O_3$, $La_2O_3$, $Gd_2O_3$, $Ce_2O_3$, $Dy_2O_3$, and $Er_2O_3$, respectively, based on the total weight of the abrasive grain.

In addition to the rare earth oxide, the alumina-based abrasive grain may further include other metal oxides that act as either metal oxide modifiers and/or a nucleating agent. Examples of such metal oxides include: iron oxide, magnesium oxide, manganese oxide, zinc oxide, chromium oxide, cobalt oxide, titanium oxide, nickel oxide, yttrium oxide, silicon dioxide, chromium oxide, calcium oxide, zirconium oxide, hafnium oxide, lithium oxide, strontium oxide, and combinations thereof. These other metal oxide(s) are selected to provide the resulting abrasive grain with the desired physical properties (e.g., hardness, toughness, and density). The addition of these other metal oxide also can effect the resulting abrasive grain microstructure.

An example of a preferred type of a rare earth oxide-modified abrasive grain of the invention comprises by weight, on a theoretical (elemental) oxide basis, about 1.2% $Y_2O_3$, about 1.2% $Nd_2O_3$, about 1.2% $La_2O_3$, and about 1.2% MgO, and about 95.2% $Al_2O_3$. Another preferred type of abrasive grain contains a surface coating such as that described in the teachings of U.S. Pat. No. 5,213,591 (Celikkaya et al.), in particular Example 10, the entire disclosure of which is incorporated herein by reference.

The preferred abrasive grain has a hardness of at least about 16 GPa, preferably at least about 18 Gpa (more preferably at least about 20 GPa and most preferably at least about 22 Gpa), and a toughness of at least about 2 $MPa \cdot m^{1/2}$, preferably at least about 18 $Mpa \cdot m^{1/2}$ (more preferably at least about 20 $MPa \cdot m^{1/2}$ and most preferably at least about 22 $MPa \cdot m^{1/2}$).

The rare earth oxide-modified alpha alumina-based abrasive can be made according to various techniques known in the art. Such techniques may include those beginning with the preparation of an alumina-based dispersion or solution. Such dispersions or solutions include an alumina hydrate-based sol, alumina particle-based dispersion, and aluminum salt solution. Preparation of such dispersions and solutions are described below. A preferred method for making the rare earth oxide-modified abrasive grain begins with the preparation of an alumina hydrate-based sol.

Alumina Hydrate Sol

Alumina hydrate sols comprise a liquid medium and alpha alumina hydrate particles, preferably alpha alumina monohydrate particles (i.e. boehmite). Suitable boehmite is commercially available, for example, under the trade designations "DISPERAL R" from Condea Chemie, GmbH of Hamburg, Germany and "DISPAL" from Vista Chemical Company of Houston, Tex. These commercially available aluminum oxide monohydrates are in the alpha form, are relatively pure (including relatively little, if any, hydrate phases other than monohydrates), and have a high surface area.

A variety of liquid media, organic or non-organic, can be utilized as the liquid for the dispersion. Suitable liquids include water, alcohols (typically $C_1$–$C_6$ alcohols), hexane, and heptane. In general, water (most preferably, deionized water) is the preferred and most widely utilized liquid medium, due primarily to convenience and cost. Typically, the dispersion contains at least 10% by weight water, preferably between 30–80% by weight water.

A peptizing agent may be added to the dispersion to produce a more stable hydrosol or colloidal dispersion. Monoprotic acids or acid compounds which may be used as the peptizing agent include acetic, hydrochloric, formic, and nitric acid.

The use of defoamers can be helpful in decreasing foaming or frothing which otherwise occurs during stirring. Suitable defoamers include citric acid and its salts. A defoamer is typically used in an amount corresponding to about 1% by weight, based on the theoretical $Al_2O_3$ content of the dispersion.

Further, the dispersion may include other additives such as organic binders (e.g., polyethylene glycol (commercially available, for example, under the trade designation "CARBOWAX" from Union Carbide of Akron, Ohio)) and organic solvent(s) (e.g., toluene and hexane). The amounts of these materials are selected to give a desired property (e.g., ease of processing, improved drying of the solids, improved green strength, and reduced foaming).

Suitable methods for mixing the dispersion include ball milling, vibratory milling, attrition milling, and/or high shear mixing (colloid mills). High shear mixing is the preferred mixing method.

In some instances, the dispersion gels prior to the drying step. The pH of the dispersion and the concentration of ions in the dispersion are critical in determining how fast the dispersion gels. Typically, the pH is in the range of about 1.5–4. Further, the addition of a metal oxide or its precursor, including a rare earth oxide precursor, may result in the dispersion gelling. For example, the addition of a rare earth oxide modifier or its precursor typically causes the boehmite sol to gel.

Alumina Particle Based Dispersion

Alumina particle dispersions contain a liquid medium and alumina material such as alpha alumina particles, particles of transitional alumina(s), or both. A preferred alpha alumina material is commercially available under the trade designation "AKP-50" from Sumitomo Chemical of Japan. Suitable transitional aluminas include chi alumina (commercially available, for example, under the trade designation "AA100W" from Alcan Corp. of Cleveland, Ohio), gamma alumina, eta alumina, and mixtures thereof.

It is preferred that the particulate alumina material, from which the dispersion is formed, comprise powdered material having a particle size distribution such that no more than about 0.5% by weight is greater than about 2 micrometers, and preferably such that no more than 5.0% by weight is greater than 1 micrometer in size (diameter or longest dimension). Preferably, the particle size is on the order of at least about 75% by weight smaller than about 0.7 micrometer, and, more preferably, 99% by weight is less than about 0.7 micrometer. Such particulate material typically not only readily forms the dispersion but also provides a more useful precursor to the desired sintered product. Alumina having particle sizes within the preferred ranges can be obtained commercially, or it can be prepared, for example, by crushing or ball milling (wet or dry) an alumina source.

A variety of liquid media, organic or non-organic, can be utilized as the liquid for the dispersion. Suitable liquids include water, alcohols (typically $C_1$–$C_6$ alcohols), hexane, and heptane. In general, water (most preferably, deionized water) is the preferred and most widely utilized liquid medium, due primarily to convenience and cost.

In general, the ratio of liquid medium to powdered alumina is dependent upon the particle size distribution as it relates to the surface area of the powdered material. If water is used, generally a weight ratio within the range of about 1:6 (i.e., liquid medium to powdered raw material) to 15:1 is usable, although ratios outside of this range may also be useful. It is typically preferred to avoid the use of excess liquids in order to minimize the extent of subsequent drying. It is, however, necessary to use a sufficient amount of liquid so the thoroughly mixed dispersion can be readily handled or moved, for example, by pouring, siphoning, pumping, or extruding.

It is foreseen that if the alumina has relatively high surface area (e.g., about 200–300 $m^2/g$; such as that commercially available under the trade designation "AA100W" from Alcan), a weight ratio of water to powder of about 5:1 to 10:1 is preferred (about 6:1 to 9:1 being most preferred). If, however, the alumina has a relatively low surface area (e.g., less than about 20 $m^2/g$; such as that commercially available under the trade designation "A16" from Alcoa), a weight ratio of about 1:6 to 2:1 is preferred.

Preferably, the solids content of the dispersion is maximized, and the solids (i.e., particles) are homogeneously dispersed therein. Preferably, the size of the pores in the material dried from the dispersion is minimized. Further, it is preferred that the distribution of pore sizes is as narrow as possible.

In general, the liquid medium, dispersed alumina, and other optional additives are mixed until a homogeneous slurry or stable dispersion is formed. This mixture, which is sometimes referred to herein as a "stable slip," is one in which, in general, the solids of the slurry do not appear by visual inspection to begin to separate or settle upon standing for about 2 hours (due, it is believed, to the viscosity of the slurry). A stable dispersion can be obtained by thoroughly mixing the alumina, a dispersion aid, and any additional raw materials and additives into the liquid medium and reducing the size of and/or deagglomerating the particles in the dispersion until the resulting dispersion is homogeneous, and the individual alumina (powder) particles are substantially uniform in size and distribution. Suitable methods for mixing include ball milling, vibratory milling, air stirrer, Coules dissolver, attrition milling and/or high shear mixing (colloid mills). Pebble (e.g., ball, vibratory, attrition) milling techniques are generally most preferred because of their ability to readily reduce the size of the alumina starting material.

Dispersions prepared as described in this section are typically thixotropic (i.e., the slurry is viscous when under no stress, but has a low viscosity when shear (e.g., mixing) is introduced). The dispersions generally are a chalky or milky liquid which can be easily poured or stirred, but which are sufficiently thick so that the solids do not settle within a two-hour period. The dispersions generally have a consistency of about that for latex paint. Undesirable lumpy or heterogenous mixtures tend to result from inadequate mixing.

To improve the consistency or stability of the dispersion or slurry, dispersions aids may be added. Dispersion aids tend to help prevent or minimize settling and improve the homogeneous nature of the slurry by helping to break down large agglomerates.

Preferred dispersion aids include strong acids (e.g., nitric acid) and bases (e.g., ammonium hydroxide), polyanionic polymers such as carboxylate functional polymers, (e.g., polyacrylic acids, polyacrylic acid copolymers, and polyacrylic acid salts), and basic aluminum salts such as basic aluminum chlorides and basic aluminum nitrates. Suitable carboxylate functional polymers are available, for example, under the trade designations "JONCRYL" from Johnson Wax, Inc., of Racine, Wis.; "CARBOPOL" from the B. F. Goodrich Co. of Cleveland, Ohio; "NOECRYL" from ICI Resins US of Wilmington, Mass.; and "VINAC" from Air Products and Chemicals, Inc., of Allentown, Pa.

The desired amount of dispersion aid is believed to depend on the surface area of the particles to be dispersed. Generally, the preferred amount of dispersion aid increases as the size of particles increases.

In general, for a dispersion employing strong acids or bases as dispersion aids, sufficient dispersion aid is used to render a pH of less than about 6 (preferably, about 2 to 3) or more than about 8 (preferably, about 8 to 10), respectively. The most preferred strong acid dispersant is typically nitric acid. Dispersions employing nitric acid as the dispersant preferably contain about 2–15% by weight nitric acid, based upon total solids content of the dispersion. The stability of such dispersions may be improved by heat treating the dispersion, for example, by autoclaving it. Dispersions employing polymeric or basic aluminum salt material as the dispersant preferably contain about 0.1–4% by weight of such dispersant, based on the total solids content of the dispersion.

The use of defoamers can be helpful in decreasing foaming or frothing which otherwise occurs during milling or stirring. Suitable defoamers include citric acid and its salts. A defoamer is typically used in an amount corresponding to about 1% by weight, based on the theoretical $Al_2O_3$ content of the dispersion.

Further, the dispersion may include other additives such as organic binders (e.g., polyethylene glycol, commercially available, for example, under the trade designation "CARBOWAX" from Union Carbide of Akron, Ohio) and organic solvent(s) (e.g., toluene and hexane). The amounts of these materials are selected to give a desired property (e.g., ease of processing, improved drying of the solids, improved green strength, and reduced foaming).

Aluminum Salt Solution

A suitable aluminum salt solution can be prepared by techniques known in the art. Typical preparation techniques include dissolving an aluminum-based salt or complex in water; or diluting or concentrating a solution comprising an aluminum-based salt or complex. Preferably, the aluminum salt solution comprises in the range of about 5 to about 45 weight percent of an alumina precursor. Preferably, the solution comprises a soluble aluminum salt or other soluble aluminum-based complex. More preferably, the solution comprises at least one of the following alumina precursors: a basic aluminum carboxylate; a basic aluminum nitrate; and a partially hydrolyzed aluminum alkoxide. Preferred solution-based sols include those comprising basic aluminum salts with carboxylate or nitrate counter ions or mixtures thereof. Preferred aluminum carboxylates are represented by the general formula, $Al(OH)_yD_{3-y}$, wherein y can range from between about 1–2, preferably between about 1–1.5, and D (the carboxylate counter ion) is formate, acetate, propionate, oxalate, the like, and combinations thereof. Aluminum carboxylates can be prepared by techniques known in the art including the methods described in U.S. Pat. No. 3,957,598, the disclosure of which is incorporated herein by reference, wherein aluminum metal is digested in a carboxylic acid solution; and U.S. Pat. No. 4,798,814, the disclosure of which is incorporated herein by reference, wherein aluminum metal is dissolved in a hot aqueous solution comprising formic acid and acetic acid.

Preferred basic aluminum nitrates are represented by the general formula, $Al(OH)_z(NO3)_{3-z}$, wherein z is in the range of about 0.5–2.5. The preparation of basic aluminum nitrates is known in the art and includes the methods taught in U.S. Pat. No. 3,340,205 and British Pat. No. 1,139,258, the disclosures of which are incorporated herein by reference), wherein aluminum metal is digested in a nitric acid solution. Basic aluminum nitrates may also be prepared according to U.S. Pat. No. 2,127,504, the disclosure of which is incorporated herein by reference, wherein aluminum nitrate is thermally decomposed.

It is within the scope of the present invention to prepare abrasive grain precursor from a dispersion prepared by adding aluminum salts to a dispersion of alpha alumina and/or alpha alumina precursor, or by mixing a dispersion of alpha alumina and/or alpha alumina precursor with an aluminum salt solution.

After the dispersion or solution is prepared, the following processes are done to prepare the rare earth oxide modified alumina-based ceramic abrasive grain.

Drying the Dispersion or Solution

In general, minimizing or reducing the amount of air or gasses entrapped in the dispersion or solution before drying (deliquifying) tends to decrease the likelihood of frothing. Less entrapped gasses generally can be correlated with a less porous microstructure, which is desirable. Degassing may be conducted, for example, by subjecting the dispersion or solution to a vacuum, with a draw on the order of about 130 cm Hg (25 psi).

Drying can be performed by any conventional means, preferably by heating. Once sufficient liquid medium has been removed from the dispersion or solution, the partially dried plastic mass may be shaped by any convenient method such as pressing, molding or extrusion, and then carefully dried to produce the desired shape such as a rod, pyramid, diamond, or cone (see section below entitled "Optional Shaping of the Dispersion or Solution"). Further, irregularly shaped abrasive grain precursor can be conveniently formed by depositing the dispersion or solution in a drying vessel such as one in the shape of a cake pan and drying, usually at a temperature below the frothing temperature of the dispersion or solution. Drying may also be accomplished by air drying or using any of several other dewatering methods (e.g., pulling a vacuum over the dispersion or solution) that are known in the art to remove the free water liquid medium of the dispersion or solution to form a solid.

Drying can also be accomplished in a forced air oven at a temperature in the range from about 50°–200° C. (preferably from about 100°–150° C.). This heating can be done on a batch or on a continuous basis. This drying step generally removes a significant portion of the liquid medium from the dispersion or solution, however generally there may be still a minor portion of the liquid medium present in the dried solid.

Optional Shaping of the Dispersion or Solution

If rendered sufficiently thick or partially dry, the dispersion or solution can be shaped by conventional means such as pressing, molding, coating, extrusion, cutting, or some combination of these steps, prior to drying, to a grit precursor form. It can be done in stages, for example, by first forming a plastic mass of partially dried flurry through extrusion, then shaping the resulting plastic mass by any convenient method, and finally drying to produce a desired shape (e.g., a rod, pyramid, disc, diamond, triangle, or cone).

If the abrasive grain precursor is shaped into a rod, the aspect ratio of the rod should be at least 0.5:1 (typically 1:1; preferably at least 2:1; more preferably at least 4:1; and most preferably at least 5:1). The cross section of the rod can be circular, rectangular, triangular, hexagonal, or the like. The rods can be made by methods known in the art (see, e.g., U.S. Pat. No. 5,090,968 (Pellow), the disclosure of which is incorporated herein by reference for its teaching of how to make rods).

Another preferred shape is a thin body having triangular, rectangular, circular, or other geometric shape. Such thin abrasive bodies have a front face and a back face, both of which have substantially the same geometric shape. The faces are separated by the thickness of the particle. The ratio of the length of the shortest facial dimension of such an abrasive particle to its thickness is at least 1:1, preferably at least 2:1, more preferably at least 5:1, and most preferably at least 6:1. A method for making such thin shaped abrasive grain is described in U.S. Pat. No. 5,201,916 (Berg et al.), the disclosure of which is incorporated herein by reference for its teaching thereto.

Conversion of the Dried Solid Into Dried Solid Particles

The dried solid is converted into dried solid particles usually by crushing. It is much easier and requires significantly less energy to crush a dried solid in comparison to a sintered, densified abrasive grain. This crushing step can be done by any suitable means such as hammer mill, roll crashing, or ball mill to form the dried solid particles. Any method for comminuting the solid can be used and the term "crushing" is used to include all of such methods. If the dried solid is shaped to a desired dimension and form, then the conversion step occurs during the shaping process. Thus, a shaped abrasive grain precursor need not be crushed after drying because a dried solid particle is already formed.

Calcining

The dried solid particle may optionally be calcined. Typically, the dried material is calcined prior to sintering. During calcining, essentially all of the volatiles and organic additives are removed from the precursor by heating to a temperature in the range from about 400°–1200° C. (preferably, about 500°–800° C.). Material is held within this temperature range until the free water and preferably 90% by weight of any bound volatiles are removed. Calcining can be conducted before optional impregnation steps, after optional impregnation steps, or both. In general, preferred processing involves calcining immediately prior to or as a last step before sintering.

Rare Earth Oxide Modifiers, Other Metal Oxide Modifiers and Nucleating Materials Added to the Dispersion or Solution The rare earth oxide modifiers, other metal oxide modifiers, nucleating materials and combinations thereof can be added to the dispersion or solution, and/or impregnated into abrasive grain precursor (i.e., dried or calcined dispersion or solution).

The rare earth oxide modifiers and optional other metal oxide modifiers are included in the abrasive grain precursor by several different techniques. In one such technique, a precursor of the rare earth oxide or other metal oxide is incorporated into the alumina sol, alumina particle dispersion and/or aluminum salt solution. These precursors are typically in the form of salts, for example nitrate, sulfate, acetate and chloride salts. The percentage or amount of the metal oxide precursor is determined to provide the desired amount of the final sintered abrasive grain.

Another means to incorporate either the rare earth oxide and/or other metal oxide modifiers is to incorporate either into the starting alumina sol, alumina dispersion and/or aluminum salt solution a metal oxide sol. These metal oxide sols comprise very small (i.e., less than one micrometer) metal oxide particles dispersed in a liquid, typically water. Suitable ceria sols are described in U.S. Pat. No. 5,429,647 (Larmie), the disclosure of which is incorporated herein by reference. Suitable zirconia sols are described in PCT Application having Publication No. WO 94/07809, the disclosure of which is incorporated herein by reference.

For a boehmite sol or an aluminum salt solution, a nucleating agent may optionally be added to the dispersion. The nucleating agent enhances the transformation to alpha alumina. Typically, the nucleating agent lowers the transformation temperature. Suitable nucleating agents include fine particles of alpha alumina, alpha ferric oxide or its precursor, chromia, titanium oxide and any other material which will nucleate the transformation. The amount of nucleating agent is sufficient to effect the transformation of alpha alumina. Nucleating such dispersions is disclosed in U.S. Pat. Nos. 4,623,364 (Cottringer et al.), 4,744,802 (Schwabel), 4,964,883 (Morris et al.), 5,139,978 (Wood), and 5,219,806 (Wood), which are all incorporated herein after by reference.

For additional details regarding the preparation of abrasive grain precursors see U.S. Pat. Nos. 4,314,827 (Leitheiser et al.), 4,770,671 (Monroe et al.), 4,744,802 (Schwabel), 4,881,951 (Wood et al.), 5,429,647 (Larmie), PCT published Applications having Publication Nos. WO 94/07809 (Larmie) and WO 95/13251 (Monroe et al.), PCT Application PCT/US93/08986 having Publication No. WO 94/07969 and the corresponding U.S. Pat. No. 5,498,269 (Larmie), the disclosures of which are incorporated herein by reference.

Impregnation and Surface Coating of the Abrasive Grain Precursor with Rare Earth Oxide Modifiers, Other Metal Oxide Modifier Material and Nucleating Material Rare earth oxide modifiers and other metal oxide modifiers can be incorporated into the abrasive grain precursor after drying, typically after the follow-up step of calcining. Precursors of various metal oxides, for example, can be incorporated by impregnation into the abrasive grain precursor. Calcined material derived from boehmite, for example, typically contains pores about 30–40 Angstrom in radius. This impregnation can be accomplished, for example, by mixing a liquid solution containing the rare earth oxide precursors (i.e., the rare earth salts) and optional other metal oxide precursor (e.g., salts) with abrasive grain precursor. Generally, about 15 ml or more of liquid carrier with the metal oxide precursor dissolved therein is mixed with each 100 grams of abrasive grain precursor material. The preferred volume of liquid carrier with the metal oxide precursor dissolved therein is dependent on the pore volume of the abrasive grain precursor material. The preferred ratio of liquid carrier with the metal oxide precursor dissolved therein per 100 grams of abrasive grain precursor material is typically within a 15–70 ml per 100 gram range. Preferably, all of the dissolved oxide precursor impregnates the abrasive grain precursor material. In general, when this method is utilized to incorporate the rare earth oxide and/or the metal oxide into the grits, the rare earth oxide and/or metal oxide modifier is preferentially portioned toward outer portion of the abrasive grain.

Impregnation can be conducted directly on the dried abrasive grain precursor from the dispersion or solution, after crushing, for example, if the liquid medium utilized is one which will not dissolve or soften the grit material. For example, if the liquid medium used for the dispersion or solution is water, a non-polar organic solvent can be used as the liquid medium for the impregnating solution for the impregnation of dried grits. Alternatively, especially if the grit material is calcined prior to the impregnation step, water can be, and preferably, is used as the carrier. For further details regarding impregnation of the porous abrasive grain precursor, see U.S. Pat. No. 5,164,348 (Wood), the disclosure of which is incorporated herein by reference.

After impregnation, the impregnated particles are dried such that the particles do not stick together or adhere to the feed tube of the calciner. In some instances, this drying step is not necessary. Next, the particles are calcined to remove bound volatile materials. Calcining is usually accomplished at a temperature of between about 400°–1000° C., preferably between 500°–800° C. The conditions for this calcination are essentially described above in the section entitled "Calcining." It is within the scope of this invention however, the first and second calcination processing conditions be different.

Further, it is within the scope of this invention to utilize more than one impregnation step. Multiple impregnation steps can increase the concentration in the porous structure of the metal oxide being carried in the impregnation solution. The subsequent impregnation solution may also have a different concentration of solids and/or a combination of different materials. For example, the first solution may contain one metal salt and the second solution may contain a different one.

Further, alumina precursors such as boehmite, soluble aluminum salts (e.g., basic aluminum carboxylates, basic aluminum nitrates, basic aluminum chlorides, partially hydrolyzed aluminum alkoxides, and combinations thereof, and combinations thereof can also be impregnated in the abrasive grain precursor.

It is also within the scope of this invention to incorporate inorganic particles in the impregnation solution to provide an impregnation dispersion. Such inorganic particles are less than about 20 micrometers in size, typically less than about 10 micrometers, preferably less than about 5 micrometers, and may be less than about 1 micrometer. During impregnation, inorganic particles that are too large to penetrate into the pores of the calcined abrasive grain precursor remain on the surface of the abrasive grain precursor. During sintering, these inorganic particles autogeneously bond to the surface of the abrasive grain providing an increased surface area. This procedure and the resulting coating are further described in U.S. Pat. No. 5,213,591 (Celikkaya et al.), the disclosure of which is incorporated herein by reference.

Another method to create a surface coating on abrasive grain according to the present invention is to bring inorganic protuberance masses (typically less than about 25 micrometers in size) in contact with the larger dried abrasive grain precursor particles or calcined abrasive grain precursor particles. Then during sintering, the small inorganic protuberance masses autogenously bond to the surface of the abrasive grain. This process and the resulting abrasive grain are further described in U.S. Pat. No. 5,011,508 (Wald et al.), the disclosure of which is incorporated herein by reference.

Sintering

The abrasive grain precursor is typically sintered at a temperature in the range from about 1000°–1600° C. (preferably, about 1200°–1500° C., more preferably, about 1300°–1450° C.). Although the length of time to which the materials should be exposed to sintering temperatures varies depending on factors such as the particle size of the abrasive grain precursor, the composition of the abrasive grain precursor, and the sintering temperature, generally sintering can be and should be accomplished within a few seconds to about 120 minutes (typically 1–10 minutes). Shorter sintering times and lower sintering temperatures generally are preferred to inhibit excess grain growth and to obtain preferred microstructures.

Sintering is typically conducted in an oxidizing atmosphere (typically air), at atmospheric pressure. It is within the scope of the present invention, however, to modify the sintering apparatus to allow sintering in neutral or reducing atmospheres. One preferred kiln is a rotary kiln that contains baffles inside to agitate the abrasive grain precursors during sintering.

Resulting Rare Earth Oxide Modified Alumina-based Abrasive Grain

In some instances, the rare earth oxide will react with the alumina to form a reaction product. For example, of dysprosium and gadolinium will react with alumina and form a garnet crystal structure. The reaction product of praseodymium, ytterbium, erbium and samarium with alumina will generally be perovskite crystal structure which may include garnet.

Additionally, certain other metal oxides may react with alumina, whereas other metal oxides do not react with alumina. For example the oxides of cobalt, nickel, zinc and magnesium react with alumina to form spinels. Yttria reacts with alumina to form a garnet structure, $Y_3A_{15}O_{12}$. Alternatively zirconia and hafnia do not react with alumina.

It is specifically noted that certain rare earth oxides and divalent metal cations react with alumina during sintering to form rare earth aluminates represented by the formula:

$$LnMAl_{11}O_{19},$$

wherein:

Ln is a lanthanide rare earth such as $La^{3+}$, $Nd^{3+}$, $Ce^{3+}$, $Pr^{3+}$, $Sm^{3+}$,$Gd^{3+}$, or $Eu^{3+}$, and M is a divalent metal cation such as $Mg^{2+}$, $Mn^{2+}$, $Zn^{2+}$, $Ni^{2+}$, or $Co^{2+}$.

Such rare earth aluminates typically have a hexagonal crystal structure that is sometimes referred to as a magnetoplumbite crystal structure. Hexagonal rare earth aluminates generally have exceptional properties in an abrasive grain and if present, are typically within the abrasive grain as a whisker(s) or platelet(s) between alpha alumina crystallites. Such crystallites are typically less than one micrometer, generally on the order of about 0.1–0.4 micrometer. A collection of these alpha alumina crystallites form a cell or domain. The adjacent alpha alumina crystallites within a cell have low angle grain boundaries. The cell size ranges from about 2–5 micrometers with high angle grain boundaries between adjacent cells. The whiskers or platelets have a thickness generally between 0.04–0.1 micrometer, preferably between 0.04–0.06 micrometer. The abrasive grain typically have a particle size ranging from about 0.1–1500 micrometers, usually between about 100–1000 micrometers.

Another hexagonal rare earth aluminate that can form during sintering is represented by the formula:

$$Ca_{1-x}Ln_xAl_{12-x}O_{19-x},$$

wherein:

Ln is a lanthanide rare earth such as $La^{3+}$, $Nd^{3+}$, $Ce^{3+}$, $Pr^{3+}$, $Sm^{3+}$, $Gd^{3+}$, or $Eu^{3+}$ and x can range from 0 to 1. This reaction product is further described, for example, in U.S. Pat. No. 5,489,318 (Erickson et al.).

It is believed that the combination of the rare earth oxide modified alumina-based ceramic abrasive grain and the fibrous reinforced thermoplastic backing results in a synergistic effect. This combination generally results in a coated abrasive product having superior abrading performance when compared to this same abrasive grain coated onto conventional vulcanized fiber and/or when compared to an iron oxide-nucleated alpha alumina-based ceramic abrasive grain coated onto this fibrous reinforced thermoplastic backing. This phenomena is demonstrated, for example, in the working examples, wherein it is shown that a coated abrasive article of the present invention, when used to abrade 1018 mild steel using the hydraulic slide action test described in the Examples, exhibits a grinding performance at least about 20% greater (preferably, at least about 50% greater, and more preferably, at least about 100% greater) than a coated abrasive article having an iron oxide-nucleated alpha alumina-based ceramic abrasive grain (in the same coating weight), the same binder adhesive as used in the coated abrasive article according to the present invention (in the same amount), and a vulcanized fiber backing.

Addition of Coatings on the Sintered Abrasive Grain

The sintered abrasive grain can be treated to provide a surface coating thereon. Surface coatings are known to improve the adhesion between the abrasive grain and the adhesive in the coated abrasive article. Such surface coatings are described, for example, in U.S. Pat. Nos. 5,011,508 (Wald et al.); 1,910,444 (Nicholson); 3,041,156 (Rowse et al.); 5,009,675 (Kunz et al.); 4,997,461 (Markhoff-Matheny et al.); 5,213,591 (Celikkaya et al.); 5,085,671 (Martin et al.); and 5,042,991 (Kunz et al.), the disclosures of which are incorporated herein by reference. Further, in some instances, the addition of the coating improves the abrading characteristics of the abrasive grain.

Preparation of the Coated Abrasive Articles

A variety of methods can be used to prepare the coated abrasive articles according to the present invention. The coated abrasive article according to the present invention comprises a plurality of rare earth oxide-modified alpha alumina-based abrasive grain bonded to the front surface of a reinforced thermoplastic backing. Optionally, the coated abrasive article further comprise abrasive grain (preferably, the rare earth oxide-modified alpha alumina-based abrasive grain) bonded to the back surface of the backing by binder adhesive. The abrasive grain on the front and back surfaces can have the same or different average particle sizes or grades. In some instances, a two sided abrasive article can be used such that both sides of the abrasive article abrade substrate or workpiece material at the same time. For example, in a small area such as a corner, one side of the abrasive article can abrade the top workpiece surface, while the other side can abrade the bottom workpiece surface.

Preferably, the backing is formed by injection molding. The actual conditions under which the thermoplastic backing is injection molded depends, for example, on the type and model of the injection molder employed.

Typically, the components forming the backing are first heated to about 200°–400° C., preferably to about 250°–300° C. (i.e., a temperature sufficient for flow). The barrel temperature of the injection molding machine is typically about 200°–350° C., preferably about 260°–280° C. The temperature of the actual mold is about 50°–150° C., preferably about 90°–110° C. The cycle time will range between about 0.5 and about 30 seconds, preferably the cycle time is about 1 second.

There are various alternative and acceptable methods of injection molding the backings. For example, the fibrous reinforcing material, e.g., reinforcing fibers, can be blended with the thermoplastic material prior to the injection molding step. This can be accomplished, for example, by blending the fibers and thermoplastic in a heated extruder and extruding pellets.

If this latter method is used, the reinforcing fiber size or length typically ranges from about 0.5 mm to about 50 mm, preferably from about 1 mm to about 25 mm, and more preferably from about 1.5 mm to about 10 mm. Using this latter method, longer fibers tend to become sheared or chopped into smaller fibers during the processing. If the backing is composed of other components or materials in addition to the thermoplastic binder and reinforcing fibers, they can be mixed with the pellets prior to being fed into the injection molding machine. As result of this method, the components forming the backing are preferably substantially uniformly distributed throughout the binder in the backing.

Alternatively, a woven mat, a nonwoven mat, or a stitch-bonded mat of the reinforcing fiber can be placed into the mold. The thermoplastic material and any optional components can be injection molded to fill the spaces between the reinforcing fibers in the mat. The reinforcing fibers can be readily oriented in a desired direction. The reinforcing fibers can be continuous fibers with a length determined, for example, by the size and shape of the mold and/or article to be formed.

In certain situations, a conventional mold release can be applied to the mold for advantageous processing. If, however, the thermoplastic material is nylon, then the mold typically does not have to be coated with a mold release.

After the backing is injection molded, the make coat, abrasive grain, size coat and optional supersize coat are typically applied by conventional techniques. For example, the adhesive layers (i.e., make and size coats) can be coated onto the backing using roll coating, curtain coating, spray coating, brush coating, or any other method appropriate for coating fluids. They can be hardened (e.g., cured), simultaneously or separately by any of a variety of methods. The abrasive grain can be deposited by a gravity feed or they can be electrostatically deposited into the adhesive coated backing.

Alternatively, the components forming the backing can be extruded into a sheet or a web form, coated uniformly with adhesive and abrasive grain, and subsequently converted into abrasive articles, as is done in conventional abrasive article manufacture. The sheet or web can be cut into individual sheets or discs. The shapes and dimensions of these sheets and/or discs can be those described above in the injection molding description. Next, the make coat, abrasive grain, and size coat can be applied by conventional techniques, such as roll coating of the adhesive binders and electrostatic deposition of the abrasive grain, to form a coated abrasive article.

Alternatively, the backing can remain in the form of a sheet or a web and the make coat, abrasive grain, and size coat applied to the backing in any conventional manner. Next, the coated abrasive article can be die cut or converted into its final desired shape or form. If the coated abrasive article is die cut, the shapes and dimensions of these sheets and/or discs can be those described above in the injection molding description. It is also within the scope of the present invention, to convert the coated abrasive article into an endless belt by conventional splicing or joining techniques.

Additionally, two or more layers can be extruded at one time to form the backing. For example, through the use of two conventional extruders fitted to a two-layer film die, two-layer backings can be formed in which one layer provides improved adhesion for the adhesive binder and abrasive grain, while the other layer may contain, for example, a higher level of filler, thereby decreasing the cost without sacrificing performance.

The adhesive binder, which can be the same or different for each of the make coat, size coat, and supersize coat can comprise a resinous adhesive. Suitable resinous adhesives are those that are compatible with the thermoplastic material of the backing. The resinous adhesive is also tolerant of severe grinding conditions and when cured adhesive binder does not deteriorate and prematurely release the abrasive grain. The resinous adhesive is preferably a thermosetting resin. Examples of suitable thermosetting resinous adhesives include phenolic resins, aminoplast resins having pendant alpha, beta unsaturated carbonyl groups, urethane resins, epoxy resins, acrylate resins, acrylated isocyanurate resins, urea-formaldehyde resins, isocyanurate resins, acrylated urethane resins, acrylated epoxy resins, or mixtures thereof.

The first and second adhesive layers, referred to in FIG. 2 as adhesive layers 12 and 15 (i.e., the make and size coats), can preferably contain other materials that are commonly utilized in abrasive articles. These materials, referred to as additives, include coupling agents, wetting agents, dyes, pigments, plasticizers, release agents, or combinations thereof. Particulate material, such as fillers and/or grinding aids, may also be used as additives in each of the first, second, and third adhesive layers 12, 15, and 16 (i.e., make, size, and supersize coats) in FIG. 2. For both economy and advantageous results, particulate materials are typically present in no more than an amount of about 50% for the make coat or about 70% for the size coat, based upon the weight of the adhesive. Examples of useful fillers include silicon compounds, such as powdered silica (available from Akzo Chemie America, Chicago, Ill.), and calcium salts, such as calcium carbonate and calcium metasilicate (available as "WOLLASTOKUP" and "WOLLASTONITE" from Nyco Company, Willsboro, N.Y.). Examples of grinding aids include potassium tetrafluoroborate, iron pyrites, cryolite, ammonium cryolite, and sulfur-containing compounds. One would not typically use more of a grinding aid than needed for desired results. The average particle size of the particulate material (i.e., fillers and grinding aids) can be within a range of about 1–50 micrometers, preferably about 5–40 micrometers, and more preferably about 10–35 micrometers.

Preferably, the adhesive binder layers, at least the first and second adhesive binder layers, comprise a resole phenolic resin and particulate material. One particularly preferred adhesive binder is formed from a conventional calcium carbonate filled resin, such as a resole phenolic resin, for example. Resole phenolic resins are preferred at least because of their heat tolerance, relatively low moisture sensitivity, high hardness, and low cost. One preferred resole phenolic resin includes a sodium hydroxide catalyst and has a viscosity of 2000 centipoise at 74% solids at room temperature. More preferably, the adhesive layers include about 45–55% calcium carbonate or calcium metasilicate in a resole phenolic resin.

Objects and advantages of this invention are further illustrated by the following examples, but the particular materials and amounts thereof recited in these examples, as well as other conditions and details, should not be construed to unduly limit this invention. All parts and percentages are by weight unless otherwise indicated.

EXAMPLES

Preparation of Thermoplastic Backing

The following is a general description of the procedure for making the thermoplastic molded discs used for the Examples. Fiberglass reinforced nylon 6/6 thermoplastic pellets were first obtained from Bayer Corp. of Pittsburgh, Pa. under the trade designation "DURETHAN BKV130". These pellets were then spread across trays in essentially a monolayer and were dried for 6 to 8 hours at about 65° C. to remove residual water as residual water tends to create processing problems during molding and even voids in the reinforced thermoplastic backing after molding. The dried pellets were dropped into the barrel of a 300 ton injection molding machine made by Van Dorn, Strongsville, Ohio. There were three temperature zones in the barrel of the injection molder. The first zone was at a temperature of about 265° C., the second at a temperature of about 270° C., and the third at a temperature of about 288° C. The nozzle of the injection molder was at a temperature of about 270° C. The mold was at a temperature of about 93° C. The time for injection was about 1 second. The screw speed was slow (i.e., less than 100 revolutions per minute), the injection pressure 100 kg/cm$^2$, the injection velocity about 0.025 m/second, and the shot size about 23 cm$^3$. The components were injection molded into the shape of a disc with a diameter of 17.8 cm, a thickness of 0.84 mm, and a center hole diameter of 2.2 cm.

Preparation of Iron Oxide-Nucleated Abrasive Grain

The iron oxide-nucleated abrasive grain were alpha alumina-based abrasive grain comprising, on a theoretical (elemental) oxide basis, about 1.2% $Fe_2O_3$, about 4.5% MgO, and about 94.3% $Al_2O_3$, and had a density greater than 95% of theoretical and submicrometer alpha alumina crystallites. These abrasive grain were prepared according to the teachings of U.S. Pat. Nos. 4,744,802 (Schwabel), and 4,964,883 (Morris et al.). Specifically, the iron oxide-nucleated abrasive grain were made according to the following process that was conducted on a continuous basis. A sol was first prepared that consisted of alpha alumina monohydrate (commercially available from Condea GMBH of Hamburg, Germany under the trade designation "DISPERAL"), nitric acid, deionized water, and an iron oxide nucleating agent. The iron oxide nucleating agent was an iron oxyhydroxide (gamma-FeOOH) aqueous dispersion (pH=5.0–5.5), about 90–95% of which is lepidocrocite, acicular particles with an average particle size of about 0.05–0.1 micrometer, a length to diameter or width ratio of about 1:1 to 2:1, and a surface area of about 115.3 $m^2$/gram. Then magnesium nitrate was added to the sol, which caused the sol to gel. Next, the gelled material was dried to remove a portion of the water. Following this, the dried material was crushed to form abrasive grain precursor particles. These precursor particles were calcined in a rotary kiln at a temperature of about 800° C., to remove residual water and other volatiles. Next, the resulting calcined particles were sintered in a rotary kiln at a temperature of about 1400°–1450° C. for a time of about 5–15 minutes. After sintering, the abrasive grain were screened to the desired particle size distribution.

Method I of Making the Coated Abrasive Article

Abrasive grain were incorporated into coated abrasive articles using conventional coated abrasive making techniques. A make coat material was prepared that consisted of 48 parts resole phenolic resin and 52 parts calcium carbonate filler. The calcium carbonate filler had an average particle size of about 25–35 micrometers. The make coat material was diluted to about 78% solids with an 80/20 blend of water and a glycol ether solvent. The make coat material was brushed onto the front side of the backing and immediately afterwards, either grade 36 or grade 50, abrasive grain were electrostatically coated into the make coat. The resulting construction was placed in an oven initially set at room temperature and then the temperature was gradually increased to 92° C., at a rate of about 1° C./minute. After the oven reached a temperature of 92° C., heating continued for two hours at 92° C. A size coat material was prepared that consisted of 32 parts resole phenolic resin, 66 parts cryolite grinding aid, and 2 parts iron oxide filler. The resulting size coat material was diluted to 75% solids with an 80/20 blend of water and glycol ether solvent. The cryolite was purchased from Washington Mills of Niagara, N.Y. under the trade designation "ABBUF" and had an average particle size of about 18–25 micrometers. The size coat material was brushed over the abrasive grain. The resulting construction was placed in an oven initially set at room temperature and then the temperature was gradually increased to 66° C., at a rate of about 1° C./minute. After the oven reached a temperature of 66° C., the discs were heated for two hours at 92° C. Following this, the oven temperature was increased to 99° C. at a rate of about 0.5° C./minute and then the discs were heated for 12 hours at 99° C. After the curing, the discs were flexed in both directions using a roll flexer. The following coating weights were used:

| ANSI Grade | Make Wet Coating Weight (grams/disc) | Abrasive Grain Coating Weight (grams/disc) | Size Wet Coating Weight (grams/disc) |
|---|---|---|---|
| 36 | 3.7 to 4.0 | 1.8 | 13.5 to 14.0 |
| 50 | 3.5 to 3.7 | 15 | 12 to 12.5 |

Method II of Making the Coated Abrasive Article

Abrasive grain were incorporated into coated abrasive articles using conventional abrasive making techniques. Each disc was individually made. A make coat material consisting of 45 parts N,N'-oxydimethylenebisacrylamide, 55 parts resole phenolic resin, 34 parts calcium carbonate filler, and 18 parts silane treated calcium metasilicate filler, diluted to 80% solids with 90/10 water/glycol ether solvent was roll coated onto the thermoplastic backing. This N,N'-oxydimethylenebisacrylamide was made in a manner similar to U.S. Pat. No. 4,903,440 (Larson) "Preparation 4", which is incorporated herein by reference, except that it was on a larger scale. The resole phenolic resin had a formaldehyde to phenol ratio of between 1.75/1–2.0/1, contained between 0.75–1.4% free formaldehyde and 6–8% free phenol, the pH was about 8.5, the viscosity was between about 2400–2800 centipoise (measured by a Norcross viscosity unit at a temperature of 38° C.±2° C.), and was 78% solids in 90/10 water/glycol ether solvent. The calcium carbonate filler had an average particle size of about 25–35 micrometers. The silane treated calcium metasilicate was purchased from NYCO (of Willsboro, N.Y.) under the trade designation "WOLLASTAKUP". The make coat was applied onto the front surface of the thermoplastic backing at a temperature between 44°–48° C. with a roll coater having a rubber-gravure sleeve over a metal roll and a notched bar to meter the coating weight of 4.6 grams per disc.

The abrasive grain were electrostatically coated using a DC power supply into and onto the wet make coat, resulting in essentially a closed coat, monolayer of abrasive grain. The abrasive grain were kept at ambient conditions before and during the coating process.

After the abrasive grain were coated, the resulting construction was passed under eight ultraviolet light "D" bulbs, 400 watts/inch each, (commercially available from Fusion Systems, of Rockville, Md.) which were used to partially cure the make coat; exposure was approximately 10 to 15 seconds. The temperature created by the UV lights was approximately 93° C., and the focal length of the lamps was about 5 cm.

Next, a size coat material was prepared that contained 32 parts resole phenolic resin, 66 parts cryolite grinding aid, and 2 parts iron oxide filler, diluted to 78% solids in 90/10 water/glycol ether solvent. The resole phenolic resin was the same as described above for the make coat material. The cryolite was purchased from Washington Mills of Niagara, N.Y. under the trade designation "ABBUF" and had an average particle size of about 18–25 micrometers. The size coat material was sprayed onto the discs at a weight of about 14.0 grams per disc with a spray unit (available from Cann-Am Company of Livonia, Mich.).

The resulting construction was then thermally cured in a conventional forced air oven at 90.5° C. for 2 hours, followed by a 12 hour final thermal cure at about 121° C. The discs were removed from the oven and allowed to completely cool to room temperature. The cooled discs were flexed in both directions using a roll flexer and then conditioned at about 24° C. and 35–45% relative humidity for at least 3 days before testing.

The coated abrasive discs were visually inspected after the UV partial cure, the spray sizing, and after the final cure for any flaws and irregularities. Flaws include voids of mineral, even mineral distribution, handling flaws and mishaps, and blisters from curing. The discs that had visible flaws were not tested.

Hydraulic Slide Action Test

The Hydraulic Slide Action Test was designed to measure the cut rate of the coated abrasive disc. The abrasive disc, prepared according to either Method I or II of Making the Coated Abrasive Article (described above), was used to grind the face of a 1.25 cm by 18 cm 1018 mild steel workpiece. The grinder used was a constant load hydraulic disc grinder. The constant load between the workpiece and the abrasive disc was provided by a load spring. The back-up pad for the grinder was an aluminum back-up pad, beveled at approximately 7°, extending from the edge and in towards the center 3.5 cm. The disc was secured to the aluminum pad by a retaining nut and was driven at 5,500 rpm. The load between the back-up pad and disc and workpiece was about 6.8 kg. Each disc was used to grind a separate workpiece for a 60 second interval. The initial cut was the amount of metal removed in the first 60 seconds of grinding. Unless otherwise noted, total cut is the total amount of metal removed during the test; total cut in grams is reported. The grinding performance data is based on an average of three discs unless otherwise noted.

Example 1

ANSI Grade 50 coated abrasive discs were prepared according to the Method I of Making the Coated Abrasive Article, described above. Four lots of discs were prepared. Lot 1 was a rare earth oxide-modified abrasive grain on a reinforced thermoplastic backing. Lot 2 was a rare earth oxide-modified abrasive grain on a vulcanized fiber backing. Lot 3 was an iron oxide-nucleated abrasive grain on a reinforced thermoplastic backing. Lot 4 was an iron oxide-nucleated abrasive grain on a vulcanized fiber backing.

The reinforced thermoplastic backing was prepared as described above under Preparation of Thermoplastic Backing. The vulcanized fiber backing was a conventional 0.76 mm thick vulcanized fiber backing available from NVF of Yorklyn, Del. The rare earth oxide-modified abrasive grain were alpha alumina-based abrasive grain comprising, on a theoretical oxide basis, about 1.2% MgO, about 1.2% $Nd_2O_3$, about 1.2% $La_2O_3$, about 1.2% $Y_2O_3$, and about 95.2% $Al_2O_3$. These abrasive grain are commercially available from the 3M Company of St. Paul, Minn., under the trade designation "321 CUBITRON". The iron oxide-nucleated abrasive grain used are described above. The test was ended when the amount of final cut was less than 35 grams/minute. The total grams of each lot are provided below in Table 1.

TABLE 1

| | vulcanized fiber backing | reinforced thermoplastic backing |
|---|---|---|
| iron oxide-nucleated abrasive grain | 1527 g, 1337 g, 1566 g (average of 3 runs: 1477 g) | 1406 g, 2817 g, 1458 g (average of 3 runs: 1894 g) |
| rare earth oxide-modified abrasive grain | 1596 g, 1400 g, 1334 g (average of 3 runs: 1443 g) | 3878 g, 3456 g, 2455 g (average of 3 runs: 3263 g) |

These results demonstrate an average improvement of 120% in the grinding performance of the rare earth oxide-modified abrasive grain on a reinforced thermoplastic backing compared to the iron oxide-nucleated abrasive grain on a vulcanized fiber backing.

Example 2

Coated abrasive discs were prepared as described in Example 1, except the grade of the abrasive grain was ANSI Grade 36. The test was ended when the amount of final cut was less than 70 grams/minute. For the discs that contained the rare earth oxide-modified abrasive grain, the cut values were based upon an average of four discs. For the discs that contained the iron oxide-nucleated abrasive grain, the cut values were based upon an average of three discs. The total grams of each lot are provided below in Table 2.

TABLE 2

| | vulcanized fiber backing | reinforced thermoplastic backing |
|---|---|---|
| iron oxide-nucleated abrasive grain | 1690 g, 1562 g, 1597 g (average of 3 runs: 1616 g) | 1748 g, 2020 g, 3770 g (average of 3 runs: 2513 g) |
| rare earth oxide-modified abrasive grain | 2834 g, 3638 g, 3059 g, 3209 g (average of 4 runs: 3185 g) | 6407 g, 4845 g, 4011 g, 7955 g (average of 4 runs: 5805 g) |

These results demonstrate an average improvement of 259% in the grinding performance of the rare earth oxide-modified abrasive grain on a reinforced thermoplastic backing compared to the iron oxide-nucleated abrasive grain on a vulcanized fiber backing.

Example 3

Coated abrasive discs were prepared as described in Example 1 (Grade 50), except the discs were prepared according to the Method II of Making the Coated Abrasive Article, above. The total average cut for each set of discs are provided in Table 3, below.

TABLE 3

| | vulcanized fiber backing | reinforced thermoplastic backing |
|---|---|---|
| iron oxide-nucleated abrasive grain | 1207 grams | 1208 grams |
| rare earth oxide-modified abrasive grain | 1204 grams | 1365 grams |

These results demonstrate an average improvement of 13% in the grinding performance of the rare earth oxide-modified abrasive grain on a reinforced thermoplastic backing compared to the iron oxide-nucleated abrasive grain on a vulcanized fiber backing. It is believed that this improvement was not as significant as the results listed above because of a difference in the binder adhesive.

Example 4

Coated abrasive discs were prepared as described in Example 3, except the grade of the abrasive grain was ANSI Grade 36. The total average cut for each set of discs are provided in Table 4, below.

TABLE 4

| | vulcanized fiber backing | reinforced thermoplastic backing |
|---|---|---|
| iron oxide-nucleated abrasive grain | 1918 grams | 1600 grams |
| rare earth oxide-modified abrasive grain | 2157 grams | 2819 grams |

These results demonstrate an average improvement of 47% in the grinding performance of the rare earth oxide-modified abrasive grain on a reinforced thermoplastic backing compared to the iron oxide-nucleated abrasive grain on a vulcanized fiber backing.

It is believed that these results demonstrate that a coated abrasive article according to the present invention, when used to abrade 1018 mild steel using the specified hydraulic slide action test, exhibits a grinding performance at least about 20% greater (preferably, at least about 50% greater, and more preferably, at least about 100% greater) than a coated abrasive article having an iron oxide-nucleated alpha alumina-based ceramic abrasive grain (in the same coating weight), the same binder adhesive as used in the abrasive article of the invention (in the same amount), and a vulcanized fiber backing.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A coated abrasive article comprising:

(a) a reinforced thermoplastic backing having a front and a back surface, wherein said backing comprises:

(i) a tough, heat resistant, thermoplastic binder material; and (ii) a fibrous reinforcing material distributed throughout said tough, heat resistant, thermoplastic binder material;

(b) a binder adhesive; and (c) rare earth oxide-modified alpha alumina-based abrasive grain bonded to said front surface of said backing by said binder adhesive; wherein said rare earth oxide-modified alpha alumina-based abrasive grain comprise:

(i) about 70–99.9% by weight alumina based on the total weight of the abrasive grain, wherein at least about 35% by weight of said alumina is present as alpha alumina;

(ii) about 0.1–30% by weight rare earth oxide selected from the group consisting of praseodymium oxide, samarium oxide, ytterbium oxide, neodymium oxide, europium oxide, lanthanum oxide, gadolinium oxide, cerium oxide, dysprosium oxide, erbium oxide and mixtures of two or more thereof, based on the total weight of the abrasive grain;

wherein said coated abrasive article, when used to abrade 1018 mild steel using a hydraulic slide action test, exhibits a grinding performance at least about 20% greater than a coated abrasive article having an iron oxide-nucleated alpha alumina-based ceramic abrasive grain, said binder adhesive, and a vulcanized fiber backing.

2. The coated abrasive article of claim 1 wherein said abrasive grain comprises about 0.1–15% by weight rare earth oxide.

3. The coated abrasive article of claim 1 wherein said abrasive grain comprises about 0.5–10% by weight rare earth oxide.

4. The coated abrasive article of claim 1 wherein said abrasive grain comprises about 0.5–5% by weight rare earth oxide.

5. The coated abrasive article of claim 1 wherein said abrasive grain further comprises a metal oxide selected from the group consisting of iron oxide, magnesium oxide, manganese oxide, zinc oxide, chromium oxide, cobalt oxide, titanium oxide, nickel oxide, yttrium oxide, silicon dioxide, chromium oxide, calcium oxide, zirconium oxide, hafnium oxide, lithium oxide, and combinations thereof.

6. The coated abrasive article of claim 1 wherein said tough, heat resistant, thermoplastic binder material has a melting point of at least about 200° C.; and said fibrous reinforcing material is individual fibers having a melting point at least about 25° C. above the melting point of said tough, heat resistant, thermoplastic binder material.

7. The coated abrasive article of claim 6 wherein said fibers are selected from the group consisting of polyvinyl alcohol fibers, polyester fibers, rayon fibers, polyamide fibers, acrylic fibers, aramid fibers, glass fibers, carbon fibers, mineral fibers, metallic fibers, and combinations thereof.

8. The coated abrasive article of claim 1 wherein said reinforced thermoplastic backing further includes a toughening agent therein.

9. The coated abrasive article of claim 8 wherein said toughening agent is a plasticizer.

10. The coated abrasive article of claim 8 wherein said toughening agent is selected from the group consisting of N-butyl-toluenesulfonamide, N-ethyl-toluenesulfonamide, toluenesulfonamide, a styrene butadiene copolymer, a polyether backbone polyamide, a rubber-polyamide copolymer, a triblock polymer of styrene-(ethylene butylene)-styrene, and a mixture thereof.

11. The coated abrasive article of claim 9 wherein said toughening agent is a rubber-polyamide copolymer or a styrene-(ethylene butylene)-styrene triblock polymer.

12. The coated abrasive article of claim 11 wherein said toughening agent is a rubber-polyamide copolymer.

13. The coated abrasive article of claim 1 wherein said tough, heat resistant, thermoplastic binder material is present in an amount of about 60–99% by weight, based upon the total weight of said backing.

14. The coated abrasive article of claim 1 further including a molded-in attachment system.

15. The coated abrasive article of claim 1 wherein said fibrous reinforcing material is a mat.

16. The coated abrasive article of claim 1 wherein said backing has an edge region and a center region; said edge region being of increased thickness relative to said center region.

17. A coated abrasive article comprising:

(a) a reinforced thermoplastic backing having a front and a back surface, wherein said backing comprises:

(i) 60–99 wt-% of a tough, heat resistant, thermoplastic binder material;

(ii) a fibrous reinforcing material distributed throughout said tough, heat resistant, thermoplastic binder material; and (iii) a toughening agent;

(b) a binder adhesive comprising a resole phenolic resin and particulate material; and (c) rare earth oxide-modified alpha alumina-based abrasive grain bonded to said front surface of said backing by said resole phenolic binder adhesive; wherein said rare earth oxide-modified alpha alumina-based abrasive grain comprise:

(i) about 70–99.9% by weight alumina, based on the total weight of the abrasive grain, wherein at least about 35% by weight of said alumina is present as alpha alumina;

(ii) about 0.1–30% by weight rare earth oxide selected from the group consisting of praseodymium oxide, samarium oxide, ytterbium oxide, neodymium oxide, europium oxide, lanthanum oxide, gadolinium oxide, cerium oxide, dysprosium oxide, erbium oxide and mixtures of two or more thereof, based on the total weight of the abrasive grain;

wherein said coated abrasive article, when used to abrade 1018 mild steel using a hydraulic slide action test, exhibits a grinding performance at least about 50% greater than a coated abrasive article having an iron oxide-nucleated alpha alumina-based ceramic abrasive grain, said binder adhesive, and a vulcanized fiber backing.

18. The coated abrasive article of claim 17 wherein said abrasive grain further comprises a metal oxide selected from the group consisting of iron oxide, magnesium oxide, manganese oxide, zinc oxide, chromium oxide, cobalt oxide, titanium oxide, nickel oxide, yttrium oxide, silicon dioxide, chromium oxide, calcium oxide, zirconium oxide, hafnium oxide, lithium oxide and combinations thereof.

19. The coated abrasive article of claim 17 wherein said tough, heat resistant, thermoplastic binder material has a melting point of at least about 200° C.; and said fibrous reinforcing material is in the form of individual fibers with a melting point at least about 25° C. above the melting point of said tough, heat resistant, thermoplastic binder material; wherein said fibers are selected from the group consisting of polyvinyl alcohol fibers, polyester fibers, rayon fibers, polyamide fibers, acrylic fibers, aramid fibers, glass fibers, carbon fibers, mineral fibers, metallic fibers and combinations thereof.

20. A coated abrasive article comprising:

(a) a reinforced thermoplastic backing having a front and a back surface, wherein said backing comprises:

(i) a tough, heat resistant, thermoplastic binder material;

(ii) a fibrous reinforcing material distributed throughout said tough, heat resistant, thermoplastic binder material; and (iii) a toughening agent;

(b) a binder adhesive comprising a resole phenolic resin and particulate material; and (c) rare earth oxide-modified alpha alumina-based abrasive grain bonded to said front surface of said backing by said binder adhesive; wherein said rare earth oxide-modified alpha alumina-based abrasive grain comprises, about 1.2% $Y_2O_3$, about 1.2% $Nd_2O_3$, about 1.2% $La_2O_3$, about 1.2% MgO, and about 95.2% $Al_2O_3$, based on the total weight of the abrasive grain.

21. The coated abrasive article of claim 1 further comprising abrasive grain bonded to said back surface of said backing.

22. The coated abrasive article of claim 21 wherein said abrasive grain bonded to said back surface of said backing comprises said rare-earth oxide-modified alpha alumina-based abrasive grain.

23. The coated abrasive article of claim 17 further comprising abrasive grain bonded to said back surface of said backing.

24. The coated abrasive article of claim 23 wherein said abrasive grain bonded to said back surface of said backing comprises said rare-earth oxide-modified alpha alumina-based abrasive grain.

25. The coated abrasive article of claim 20 further comprising abrasive grain bonded to said back surface of said backing.

26. The coated abrasive article of claim 25 wherein said abrasive grain bonded to said back surface of said backing comprises said rare-earth oxide-modified alpha alumina-based abrasive grain.

* * * * *

UNITED STATES PATENT AND TRADEMARK OFFICE

CERTIFICATE OF CORRECTION

PATENT NO. : 5,669,941
DATED : September 23, 1997
INVENTOR(S) : Larry L. Peterson and Harold E. Rude It is certified that error appears in the above-identified patent and that said Letters Patent is hereby corrected as shown below:

Title page,
Item [75], Inventors, please delete "Larry L. Peterson, Hudson, Wis." and insert therefore -- Larry L. Peterson, Hudson, Wis., and Harold E. Rude, Roseville, MN --.

Column 28,
Line 8, please delete "1.8" and insert therefore -- 18 --.

Signed and Sealed this

Twenty-sixth Day of November, 2002

*Attest:*

*Attesting Officer*

JAMES E. ROGAN
*Director of the United States Patent and Trademark Office*